US010625991B2

(12) United States Patent
Stuedal et al.

(10) Patent No.: US 10,625,991 B2
(45) Date of Patent: Apr. 21, 2020

(54) DECK HOIST TRACTOR, RESCUE CHUTE AND TOTE TANK

(71) Applicant: Kværner AS, Lysaker (NO)

(72) Inventors: Odd Inge Stuedal, Trondheim (NO); Knut Engene, Trondheim (NO)

(73) Assignee: Kværner AS, Lysaker (NO)

( * ) Notice: Subject to any disclaimer, the term of this patent is extended or adjusted under 35 U.S.C. 154(b) by 0 days.

(21) Appl. No.: 16/092,727

(22) PCT Filed: Apr. 18, 2017

(86) PCT No.: PCT/EP2017/059201
§ 371 (c)(1),
(2) Date: Oct. 10, 2018

(87) PCT Pub. No.: WO2017/178661
PCT Pub. Date: Oct. 19, 2017

(65) Prior Publication Data

US 2019/0127188 A1 May 2, 2019

(30) Foreign Application Priority Data

Apr. 15, 2016 (NO) ..... 20160633

(51) Int. Cl.
*B66C 19/00* (2006.01)
*A62B 1/20* (2006.01)
(Continued)

(52) U.S. Cl.
CPC ..... *B66C 19/005* (2013.01); *A62B 1/20* (2013.01); *B63B 27/10* (2013.01); *B63B 27/30* (2013.01); *B66C 19/00* (2013.01); *B66C 23/48* (2013.01)

(58) Field of Classification Search
CPC ..... B66C 19/00; B66C 19/005; B66C 23/36; B60P 1/00; B60P 1/022; B60P 1/54; B60P 1/5438; B60P 1/5442; B60P 1/5457
See application file for complete search history.

(56) References Cited

U.S. PATENT DOCUMENTS 708,551 A * 9/1902 Hill ..... B66C 23/36 212/175
1,008,338 A * 11/1911 Holt ..... B66C 23/36 212/172
(Continued)

FOREIGN PATENT DOCUMENTS

AU 6146673 A 4/1975
CA 2633332 A1 12/2008
(Continued)

OTHER PUBLICATIONS

Serôdio, Renato, "International Search Report," prepared for PCT/EP2017/059201, as completed on Oct. 26, 2017, seven pages.
(Continued)

*Primary Examiner* — Michael R Mansen
*Assistant Examiner* — Juan J Campos, Jr.
(74) *Attorney, Agent, or Firm* — Winstead PC

(57) ABSTRACT

A deck hoist tractor (DHT) for an unmanned platform (1) comprising an elongated base frame structure (12) carrying respective caterpillar drives (18) on each side enabling the tractor (2) to move forward and rearward, characterised in that the tractor (2) further comprising a tower frame structure (10) extending in substantially vertical direction from one end section of the base frame structure (12), which tower frame structure (10) is carrying a cantilevered top frame structure (11) carrying a lifting apparatus (22, 21), said caterpillar drives (18) are located at the same end section as said top frame structure (11), that said base frame structure (12) is extended by respective cantilevered beams
(Continued)

(12*a*) space apart with an opening between them, each cantilevered beam (12) having an adjustable support structure (19) adjacent to their distal end (12*b*) from the caterpillar drive (18), said cantilevered top frame structure (11) is extended to vertically correspond with said respective cantilevered beams (12*a*), and said lifting apparatus (20, 21) is arranged to be shifted both forward and rearward, in addition to laterally in said top frame structure in order to position a load supported in the lifting apparatus. The invention also relates to a temporarily installed escape chute (54) and a method for installing and removing a tote tank (70) on the platform (1).

8 Claims, 22 Drawing Sheets

(51) Int. Cl.

| | |
|---|---|
| ***B63B 27/10*** | (2006.01) |
| ***B63B 27/30*** | (2006.01) |
| ***B66C 23/48*** | (2006.01) |

(56) References Cited

U.S. PATENT DOCUMENTS

| | | | | | |
|---|---|---|---|---|---|
| 1,673,307 | A | * | 6/1928 | Best | B66C 23/36 254/323 |
| 2,504,232 | A | * | 4/1950 | Smith | B60P 1/5442 414/542 |
| 3,433,459 | A | | 3/1969 | Logan | |
| 3,768,670 | A | * | 10/1973 | Cloud | A61G 19/00 414/543 |
| 5,090,667 | A | | 2/1992 | Harrell | |
| 5,188,247 | A | | 2/1993 | Jastrow | |
| 5,743,702 | A | * | 4/1998 | Gunderson | B60P 1/5442 224/403 |
| 5,908,279 | A | * | 6/1999 | Mote | B60P 3/224 414/542 |
| 2005/0098559 | A1 | | 5/2005 | Morales et al. | |
| 2008/0116007 | A1 | | 5/2008 | Johnson | |
| 2015/0122763 | A1 | | 5/2015 | Bobenrieth Giglio | |

FOREIGN PATENT DOCUMENTS

| | | | |
|---|---|---|---|
| DE | 102010005875 | A1 | 9/2010 |
| EP | 2792591 | A1 | 10/2014 |
| GB | 2163402 | A | 2/1986 |
| JP | 3401704 | B2 | 4/2003 |
| WO | WO-2004033043 | A2 | 4/2004 |
| WO | WO-2016122334 | A1 | 8/2016 |

OTHER PUBLICATIONS

Risk Safety Systems US Inc., "Manufactures of Onshore & Offshore Escape Chute," URL: https://web.archive.org/weh/20160401023336/http://www.risksafetysystems.com, Retrieved: Oct. 26, 2017.

Kvçrner, "Material Handling," Technical Report, Chapter 12, dated Apr. 15, 2016, 17 pages.

* cited by examiner

DECK HOIST TRACTOR, RESCUE CHUTE AND TOTE TANK

TECHNICAL FIELD

This invention relates to a deck hoist tractor for handling of materials on offshore installations, and in particular unmanned wellhead platforms The invention also relates to an escape chute for use on an unmanned wellhead platform and a method for installing or removing a tote tank on the unmanned wellhead platform.

BACKGROUND ART

A normally unmanned installation offshore is a type of automated oil or gas platform designed to be primarily remotely operated, without the constant presence of personnel.

These platforms are generally characterized by their small size. They are often a compromise between providing the convenience of surface wellheads, which are easier to build and maintain and avoiding the high operating cost of a full production platform.

The unmanned platforms are commonly serviced from a nearby larger platform. Regular visit may be made for routine maintenance and for smaller well work, such as wireline operation by for instance a service operation vessel.

Even though the platforms are small and most of the time unmanned there is a requirement for equipment that fulfills the safety regulations when the platform is manned. The reduced space also requires other solutions than normal platforms.

The platforms are considered to be in an environment with a potentially explosive atmosphere due to the presence of gases, vapor, mist or dust. An ignition may cause an explosion in these environments. To avoid this there is strictly requirements to which equipment that can be used directly in the explosive atmosphere.

The overall design philosophy for the unmanned platform is to minimize the equipment on the platform, thus minimizing the requirement for visiting the platform to operation and maintenance. Planned visits to the platform could be limited to once a year except for unplanned well maintenance. Further, focus is on efficient and safe evacuation if for some reason a leakage and/or fire should occur during a visit.

Due to the operation of these platforms, there are needs for new equipment that are adapted for these specific platform types.

A deck hoist tractor is proposed to handle materials on weather deck and between decks during the drilling phase with the presence of a jack up rig. This is a newly developed concept but devices with similar functionality have been used before on offshore installations. One example is the offshore oil installation Ringhornet.

The deck hoist tractor is required to meet the requirements in the ATEX directive regarding minimizing explosion. This deck tractor is therefore powered on the unmanned wellhead platform by supply from the jack up rig or main installation umbilical.

The deck hoist tractor provides material handling of different loads that are performed by precise and safe lifting operations on offshore installations.

The publication AU61466 relates to a material handling system and means for unloading material from a vehicle and transporting the material to a desired location, the handling system is preferable used in a construction site and not on an offshore platform as the deck hoist tractor according to the invention. The publication comprises a lower frame that supports belts for movement of the system but do not describe any possibility for precise positioning of a load to be hoisted.

Publication U.S. Pat. No. 5,090,667 and DE102010005875 discloses technical background of the invention.

None of the publications describes a hoist tractor that could be used on a platform that fulfills the safety regulations set for the platform and at the same time could perform installation lift in demanding atmosphere safely and with precision.

An escape chute represents an emergency evacuation system that is designed to provide rapid means of escape.

An escape chute shall be installed during all visits on the unmanned wellhead platform. The invention allows for that this installation could be performed by the crane on a service operation vessel that are connected to the platform during for instance maintenance of the platform.

A tote tank could have many purposes in the industry. A tote tank is normally a standardized tank with a load carrier and protection that are integrated in the tank.

Publication US2005/0098559 relates to a tote tank for transporting dangerous liquids between the dock and the offshore platform.

Publication 2633332 discloses another example of a traditional tote tank for storing liquids at various work sites.

The tote tanks in the publication are adapted to be arranged on a deck, vessel or other work sites.

The unmanned platform has however a constricted area where the tote tank may be installed by a crane and which at the same time is low enough to allow fluid to flow into the tank.

The invention solves this problem by providing a method for installing and connecting a tote tank in an unmanned platform by arranging the tote tank in a recess in the landing platform or directly on the platform.

OBJECT OF THE INVENTION

It is an object of the invention to provide a deck tractor that is able to perform lift with high precision in a demanding atmosphere. It is also an object of the invention that the deck tractor according to the invention is able to correct the position along two different axis in the plane.

It is another object of the invention to provide a deck tractor that is able to perform lift of high risk and the lift is dual secured when used over pressurized equipment.

It is another object of the invention to provide a deck tractor that positioning the center of gravity of the load in a center position in relation to the belt in order to achieve an even pressure on the belts and stability of the tractor without the use of support legs during transportation of the load.

It is yet another object of the invention to provide projecting support legs. These legs are also adopted to be lowered to the ground. This provides a safe installation near the hatchway in the deck. The support legs are positioned safely by the opening/hatchway and lowered while the stability is secured by the belt system. After the support legs are lowered, the load can be moved forward by the movable hoisting arrangement and transfer the load to the support legs gradually.

It is a further object of the invention to provide a hoist arrangement and a tractor that satisfies the conditions of the zone 1 area offshore, ie area which contains hazardous gas/air mixture under normal operating conditions.

It is yet another object of the invention that the deck hoist tractor is movable between different locations in the platform, while at the same time has capacity of a gantry crane and may perform similar lifting operations suitable for this crane, also including lift above a wellhead.

It is also an object of the invention to provide a deck hoist tractor that is able to move a load from one location to another on the deck of the platform.

When it comes to method and functions, the following is to be noticed:

The deck hoist tractor is developed to enable well completion as a parallel operation to moonpool activities from jack up-rig, (drilling//casings/completion etc.) by inherited properties as follows:

- Able to operate in restricted height environment, for instance below cantilever of the jack up-rig
- Able to operate in accordance with all regulations and zone classification offshore at Norwegian sector and worldwide.
- Capable of lifting and transportation of heavy materials
- Safe operation when approaching and in vicinity of hatch openings (no support in front of device during transit)
- Can replace permanent crane solutions for internal material handling on offshore installations as pedestal cranes and gantry cranes.
- Optimized solution for installation lifts. Most crane solutions, especially for this size of workload, don't have the accuracy and stability that makes them ideal for installation lifts.
- Mobile unit, can be used on several installations and when needed, certification/maintenance can be accomplished onshore
- Distributes loads evenly and at a large area on deck structure It is a main object of the escape chute according to the invention to provide a temporarily emergency installation that is adapted to be brought to the platform when needed, for instance during maintenance work etc.

Between the operations, the escape chute is de-installed and transported away from the platform. It is then easy to perform maintenance, inspection and certification on the escape chute so that is ready to be used again offshore.

It is another object of the invention to provide a frame structure which acts as guide structure and protection for the emergency chute when installed and de-installed on the platform.

It is also an object of the invention to provide a boarding platform on the platform deck before personnel are entering the platform.

It is yet another object of the present invention to minimize the remaining structure of the platform, ie the structure of the platform when the emergency chute is not installed. This reduces the influence of wind and waves that a deck structure could cause since a large deck structure could generate large forces.

It is an object of the invention to provide a method for installing temporarily a tote tank on the platform in a restricted area which at the same time is a low point drain to allow spill water to flow into the tank.

It is another object of the invention to provide a method where the tote tank is easy to install and to remove from the platform.

It is a further object of the invention to provide a method for installing temporarily a tote tank on the platform which do not restrict the available space on the platform.

SUMMARY OF INVENTION

The present invention relates to a deck hoist tractor (DHT) for an unmanned platform comprising an elongated base frame structure carrying respective caterpillar drives on each side enabling the tractor to move forward and rearward, a tower frame structure extending in substantially vertical direction from one end section of the base frame structure, which tower frame structure is carrying a cantilevered top frame structure carrying a lifting apparatus, where said caterpillar drives are located at the same end section as said top frame structure, that said base frame structure is extended by respective cantilevered beams space apart with an opening between them, each cantilevered beam having an adjustable support structure adjacent to their distal end from the caterpillar drive, said cantilevered top frame structure is extended to vertically correspond with said respective cantilevered beams, and said lifting apparatus is arranged to be shifted both forward and rearward, in addition to laterally in said top frame structure in order to position a load supported in the lifting apparatus.

Thus, with such a deck hoist tractor, it is possible to both hoist and transport heavy loads on a platform deck in one and same operation without interfering with other equipment. During the hoisting operation, the adjustable support structures on the cantilevered beams are extended to get in contact with the platform deck and hence prevent any tilting of the deck hoist tractor during a hoisting operation. Such hoisting of a load may also take place from a lower deck and up through a deck opening, or a well bay. The respective cantilever beams are in such a situation straddling over the deck opening and supported in the distal ends by the respective adjustable supports. After the hoisting operation, the lifting apparatus including the load is shifted towards the caterpillar drives in order to bring the center of gravity of both the load and lifting apparatus centrally relative to the caterpillar drives. After the shifting operation, the adjustable support structures are retracted and elevated from engagement with the platform deck. Now the deck hoist tractor is ready for transportation of the load to destination. At destination, the described sequences are reversed, either the load is just dropped off or it is lowered through a deck opening. The deck hoist tractor provides demanding installation lifts in a demanding atmosphere.

Preferable embodiments of the deck hoist tractor are defined in the dependent claims 2-8.

The invention also relates to a use of the hoist deck tractor on an unmanned platform for hoisting load through a hatchway opening.

The present invention also relates to a temporarily arranged escape chute unit for an unmanned wellhead platform having a collapsible tube mounted in a main part, the escape cute further comprising a frame structure enclosing the main part, said frame structure being configured to mate and be supported with a guiding frame onboard said unmanned platform when the escape chute is installed on the platform (1).

This provides a quick and easy installation of the escape chute on the platform and which can be reused on different platform.

The escape chute according to the invention is prepared for transfer from a SOV (Service Operation Vessel) to a UWP (Unmanned Wellhead Platform), comprising a lifting frame having a guiding function, an integrated platform having detachable hand railings, which unit is adapted to mate and be supported with a guiding/resting frame onboard said UWP, said escape chute unit being designed to be installed directly by the SOV crane, together with a self-release crane hook allowing for installation of said chute before people is entering said UWP.

Preferable embodiments of the escape chute are defined in the dependent claim 11-16.

Further the present invention also relates to a method for installing a tote tank according to claim 17 and a method for removing a tote tank according to claim 18 to/from the platform.

The method provides a method for installing a tote tank that is able to easily receive fluid from the platform and be located without interference with operations.

The tote tank is for for temporary location on a UWP during campaigns, for connection to an open drain system, pump line and vent by hard-pipe and quick connect flexible hose connections during said campaign, which tote tank may include an integrated pump for draining of the tank.

DETAILED DESCRIPTION OF THE INVENTION

The foregoing features of the invention will be more readily understood by reference to the following detailed description taken with reference to the accompanying drawings.

The definitions in the application shall be interpreted broadly throughout the application.

Figure 1:
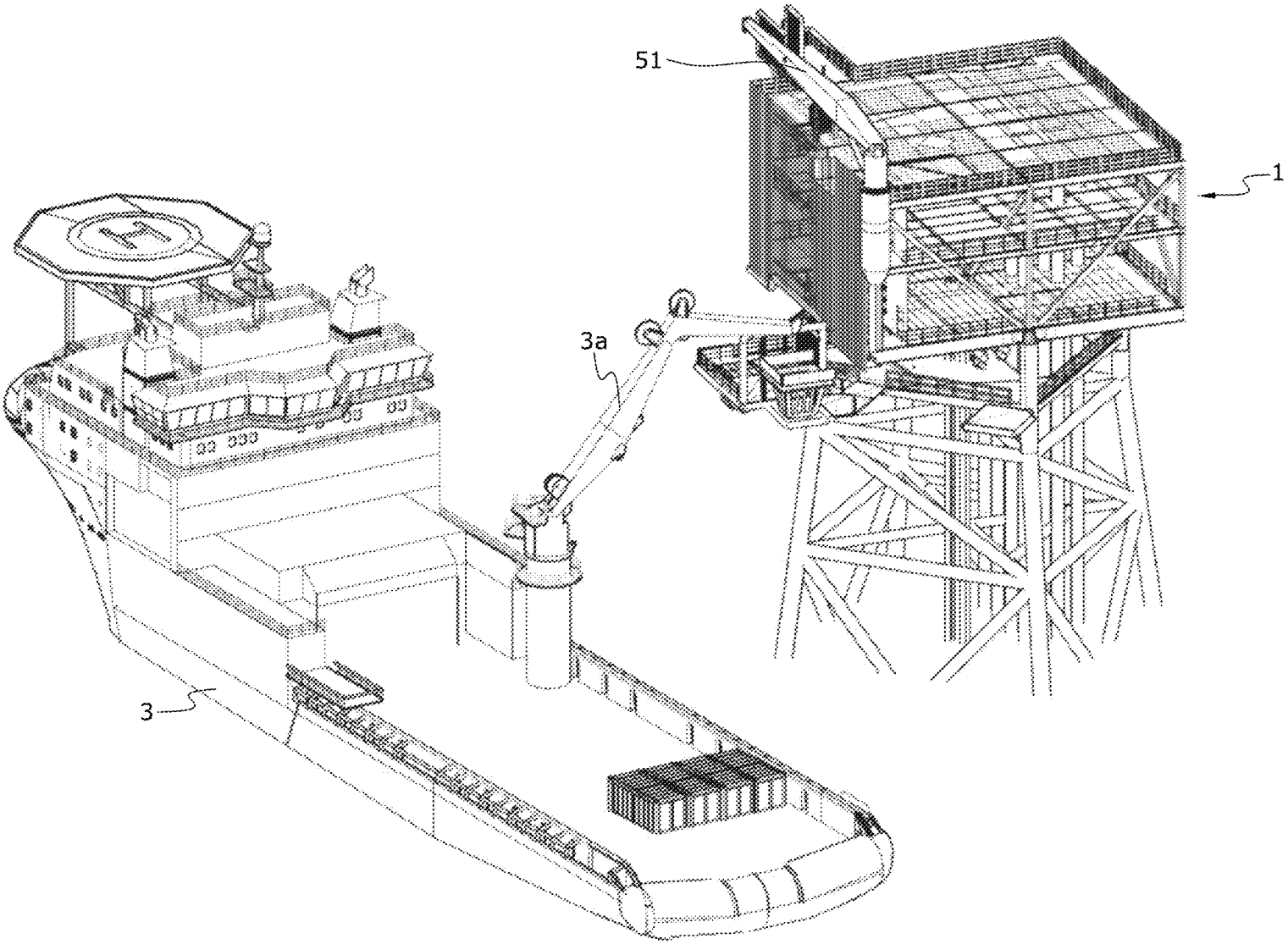
FIG. 1 shows a principle view of an unmanned platform and a service operation vessel that could be arranged nearby the platform to perform different service to the platform.

FIG. 1 shows an overall view of an unmanned platform 1 where a deck hoist tractor 2 (FIG. 2) according to the invention preferably is operating.

The FIG. 1 shows further a service operation vessel 3 that provides a support for the unmanned platform when maintenance of the platform, intervention operation or similar operation on the platform.

Figure 2:
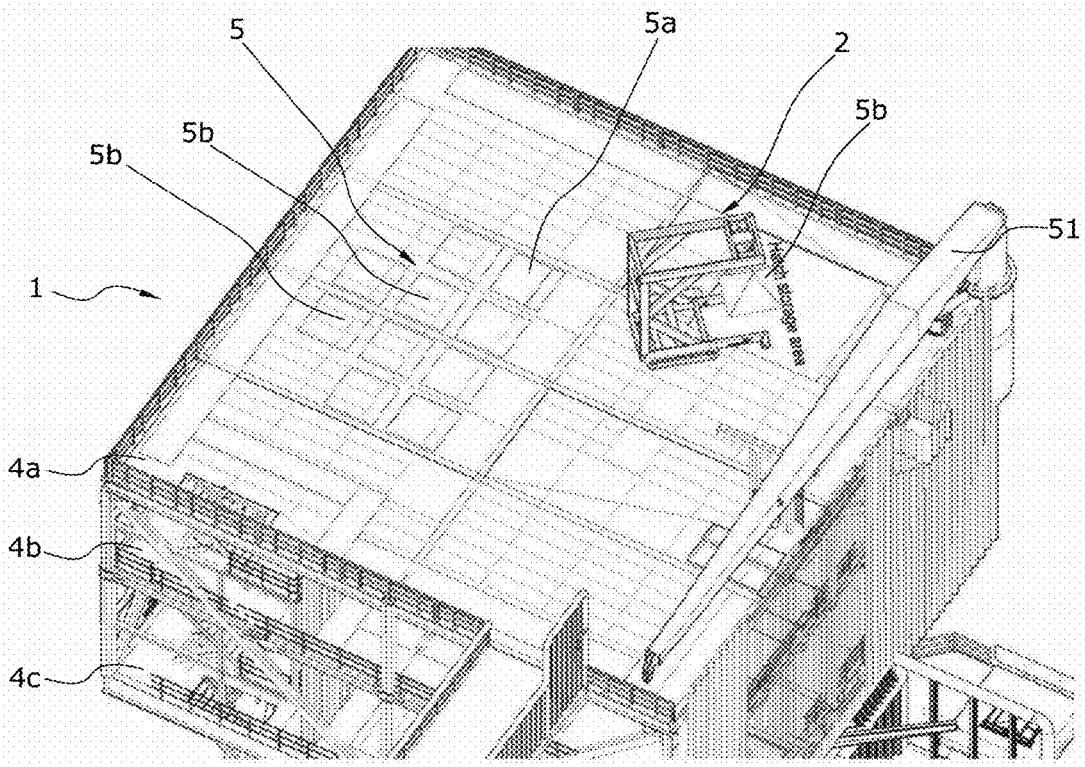
FIG. 2 shows an unmanned platform viewed from above.

FIG. 2 shows the deck hoist tractor 2 arranged on the deck of the platform 4*a*, also named weather deck.

The deck hoist tractor 2 is suitable as the main handling tool on the weather deck 4*a* for materials exceeding the limit for manual handling by use of trolleys etc.

The deck hoist tractor will cover the following needs for material during drilling phase:

- Handling of all material from weather deck landing to relevant positions on weather deck 4*a*.
- Lift and transport well bay hatches 5*b*.
- Lift, transport and installation of starter/uni-head, tree adapter and X-tree 6*a*.
- Lift and transportation of conductor cuttings 6*b*.
- Lift transport and lowering of conductor hang-off frame parts.
- Lift, transport and install of identified items for wireline operations during drilling phase (well bay hatch removal and installation, wireline pressure control equipment including wireline BOP).
- Material handling between all deck levels either by well bay hatch openings 5*a* or through vertical material handling shaft/hatch.

The deck hoist tractor 2 is not limited in use to the unmanned platforms 1 but could also be used on other types offshore installation that needs material handling in a potential hazardous area. The tractor could be used on any of the deck of the platform 1.

The platform in FIG. 2 comprises a number of decks 4*a*, 4*b*, 4*c* arranged on top of each other in a rectangular module which constitutes the platform 1. The FIGS. 1 and 2 shows three decks but any number of decks 4*a*, 4*b*, 4*c* are possible. There is indicated a number of hatchways in the upper deck or weather deck 4*a* of the platform 1. The hatchway comprising a hatch opening 5*a* and a hatch cover 5*b*. When not in use the hatch cover 5*b* covers the opening 5*a* in the hatchway 5 so that the deck 4*a* forms a continuous surface without any openings 5*a*. Similar hatchways 5 could be arranged on the other decks 4*b*, 4*c* of the platform 1 (not shown) These hatchways are suitable for transferring different loads to or from the deck, in addition the hatchways 5 could store different arrangement in an a space saving and easy manner. This will be described further in relation to the relevant equipment.

Figure 3:
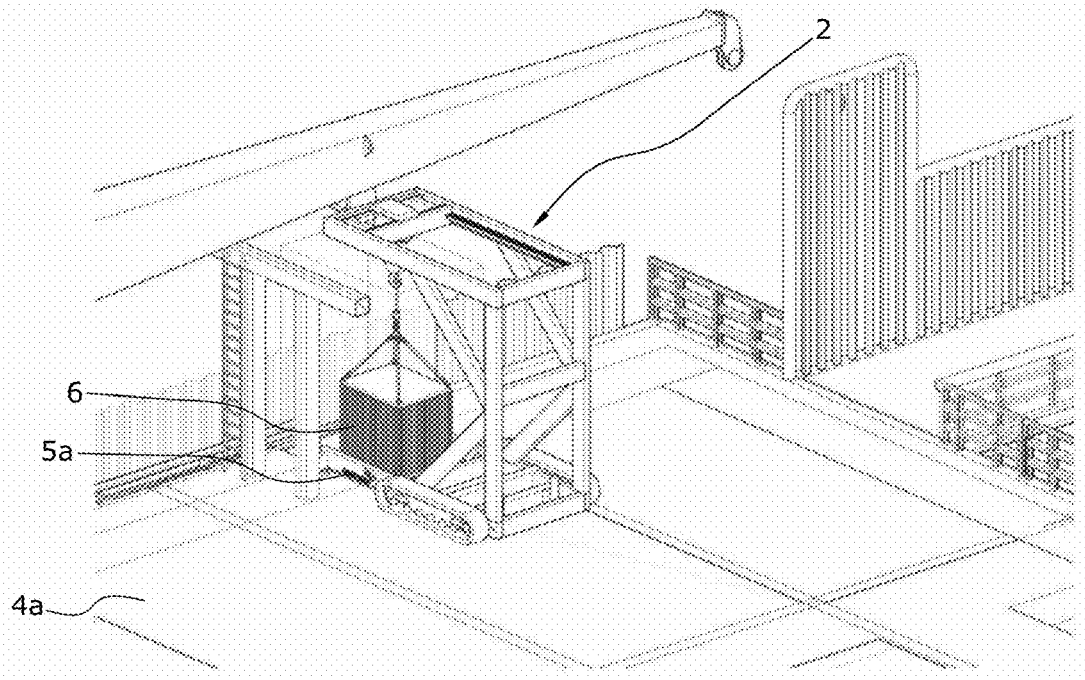
FIG. 3 shows the hoist deck tractor performing a lift over a hatchway.

FIG. 3 shows the deck hoist tractor 2 with a load 6 that is to be lowered through one of the hatchways 5 from a first deck 4*a* to the second deck 4*b* arranged beneath the first deck 4*a*. The load 6 to be lowered or lifted is in this position arranged away from the main structure of the deck tractor 2. It is therefore necessary to have a lower structure that support the load 6. This will be further describe in FIGS. 14 and 15.

The deck hoist tractor 2 may also be used as a transport and lifting device for handling materials from a landing platform 50 to other decks on the unmanned platform 1. These lifts may also be performed by a main crane 51 that is fixedly arranged on the platform 1. The main crane 51 may be positioned to establish a lifting point for material handling between the deck levels.

FIG. 4-7 shows the deck hoist tractor 2 according to the invention viewed from different sides.

Figure 4:
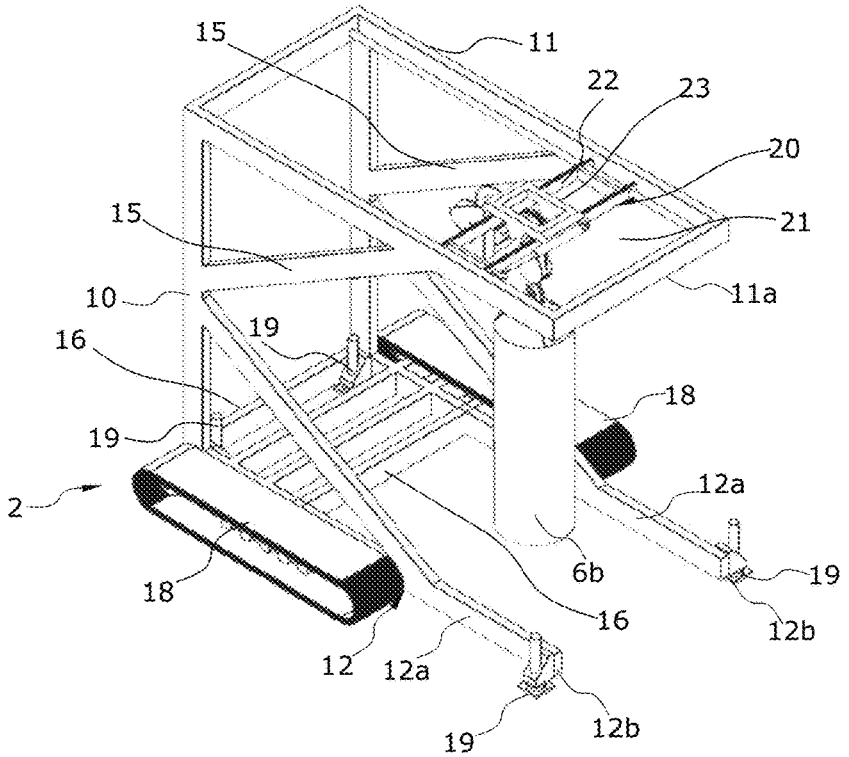
FIG. 4 shows a perspective view of the deck hoist tractor according to the invention.

FIG. 4 shows a perspective view of the deck hoist tractor 2. The deck hoist tractor 2 comprises an elongated base frame structure 12, a tower frame structure 10 with support beams 15, 16, 17 and a top frame structure 11.

Support beams 15, 16, 17 are arranged between the different parts to obtain the structure.

The elongated base frame structure 12 is extended by a pair of cantilevered beams 12*a*. The cantilevered beams 12*a* are arranged space apart with an opening between them by first support beams 16.

The tower frame structure 10 and the elongated base frame structure 12 are supported by a pair of second support beams 17 extending between each of the tower frame structure 10 and the base frame structure 12.

The tower frame structure 10 extending vertically correspondent with the first pair of cantilevered beams 12*a* from the opposite end of the elongate base frame 10 than the pair of cantilevered beams 12*a*. The top frame structure 11 is supported by a pair of third support beams 15 extending between respective vertical beams in the tower frame structure 10 towards the top frame structure 11. Both the cantilevered beams 12*a* and the top frame structure 11 having respective free ends 11*b*, 12*b* extending further from the connection between the support beams 15, 17 as shown in the figure.

The base frame structure 12, the tower frame structure 10 and the top frame structure 11 forming an integrated framework structure shaped as a cube with one open frame side. The support beams 15, 16, 17 may be arranged in different manner to achieve this.

The deck hoist tractor 2 further comprising caterpillar drives 18. There is arranged two corresponding caterpillar drives 18 on each of the elongate base structure 12. The caterpillar drives 18 are preferably arranged on the each side of the cantilevered beams 12*a* facing away from each other.

The caterpillar drives 18 facilitates the movement of the deck hoist tractor 2. The caterpillar drives 18 are preferably powered by non-ignitable propulsion means (not shown).

The non-ignitable propulsion means could for instance be air that is facilitated on the platform 1 by supply from the service operation vessel 3 or a jack up rig. The non-ignitable means could also be hydraulic arrangement to power the movement of the deck hoist tractor 2. The movement of the deck hoist tractor 2 is performed in a controllable manner in moderate speed. The non-ignitable propulsion system is configured to operate the motion of the at least one support structure.

Figure 8:
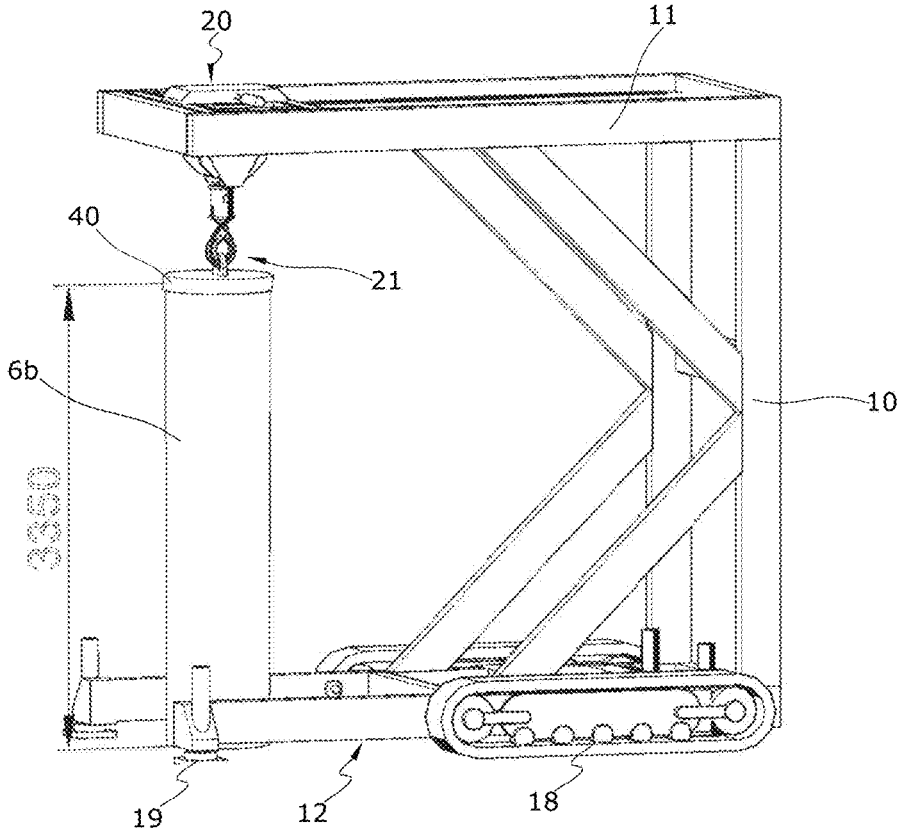
FIG. 8-9 shows a detailed view of the movement of a load along the cantilevered top structure of the tractor.
Figure 9:
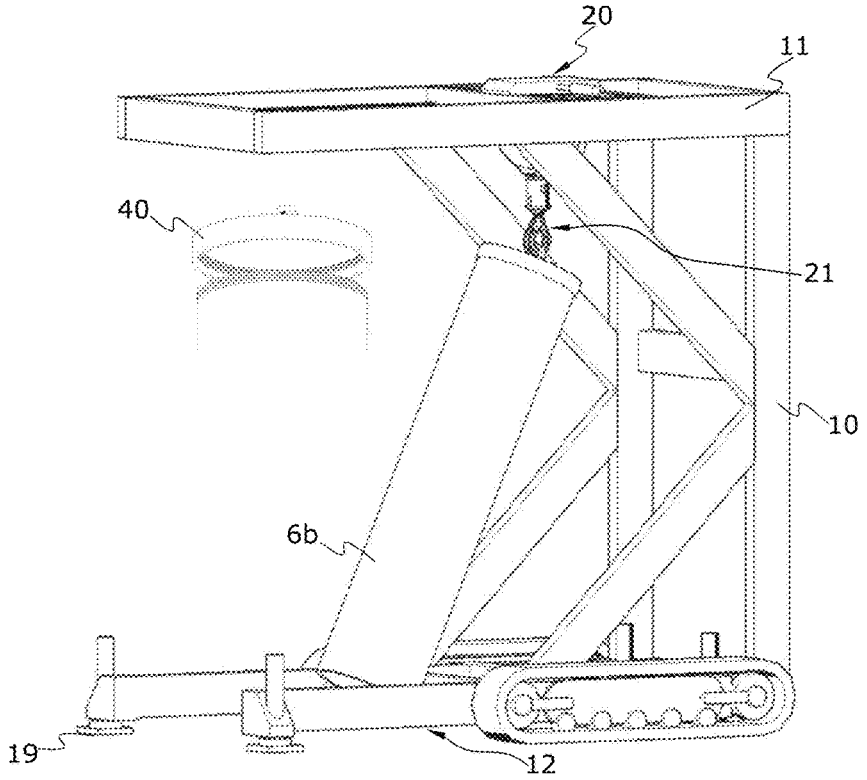

The deck hoist tractor 2 further comprises at least one adjustable support structure 19. In the embodiment shown in FIG. 4, there are arranged four single support structures 19 at each distal ends of the cantilevered beams 12*a*. The support structures 19 are telescopic and adapted to be retracted when the deck hoist tractor 2 being moved on the platform deck 4*a*, 4*b*, 4*c*. When the deck hoist tractor 2 is placed over a hatchway opening 5*a* or other location where it is to perform a lifting or lowering operation, the support structures 19 are lowered to the foundation or deck beneath the deck hoist tractor and locked in this position. The support structures 19 and the cantilevered beams 12 constitutes in this position a stable support for the deck hoist tractor 2. This is transferred from the caterpillar drive 18 where the main support for the hoist deck tractor 2 is while the tractor 2 is moving. The support structure 19 prevents the deck hoist tractor 2 from tipping while performing the lifting or lowering operations. This is illustrated in FIGS. 8 and 9.

The deck hoist tractor 2 further comprises a lifting apparatus 20, 21 for performing high precision lifting of loads by the deck hoist tractor.

Figure 7A:
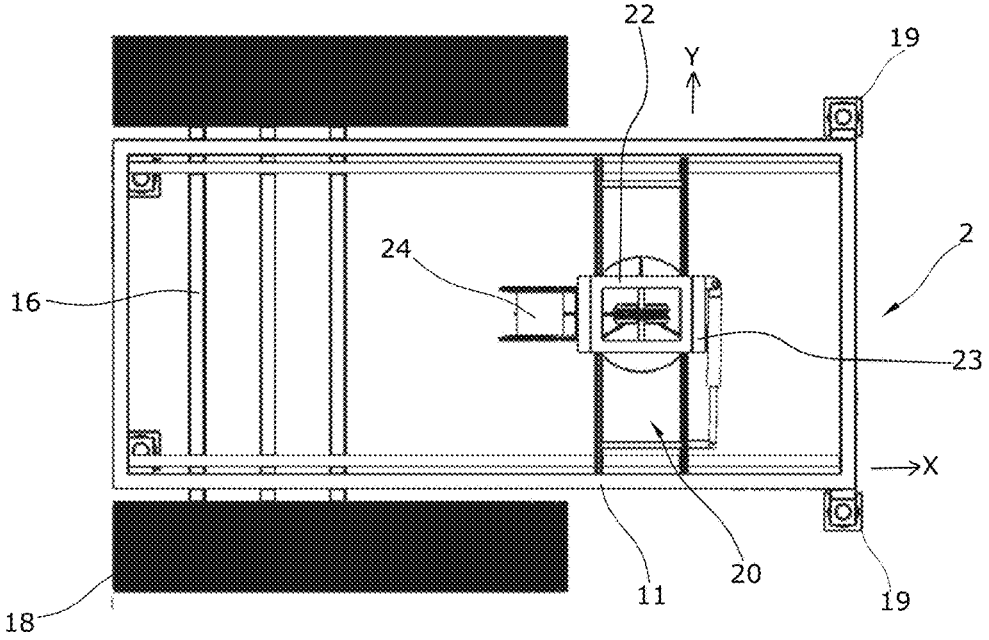
FIG. 7*a* shows the deck hoist tractor according to the invention viewed from above.
Figure 7B:
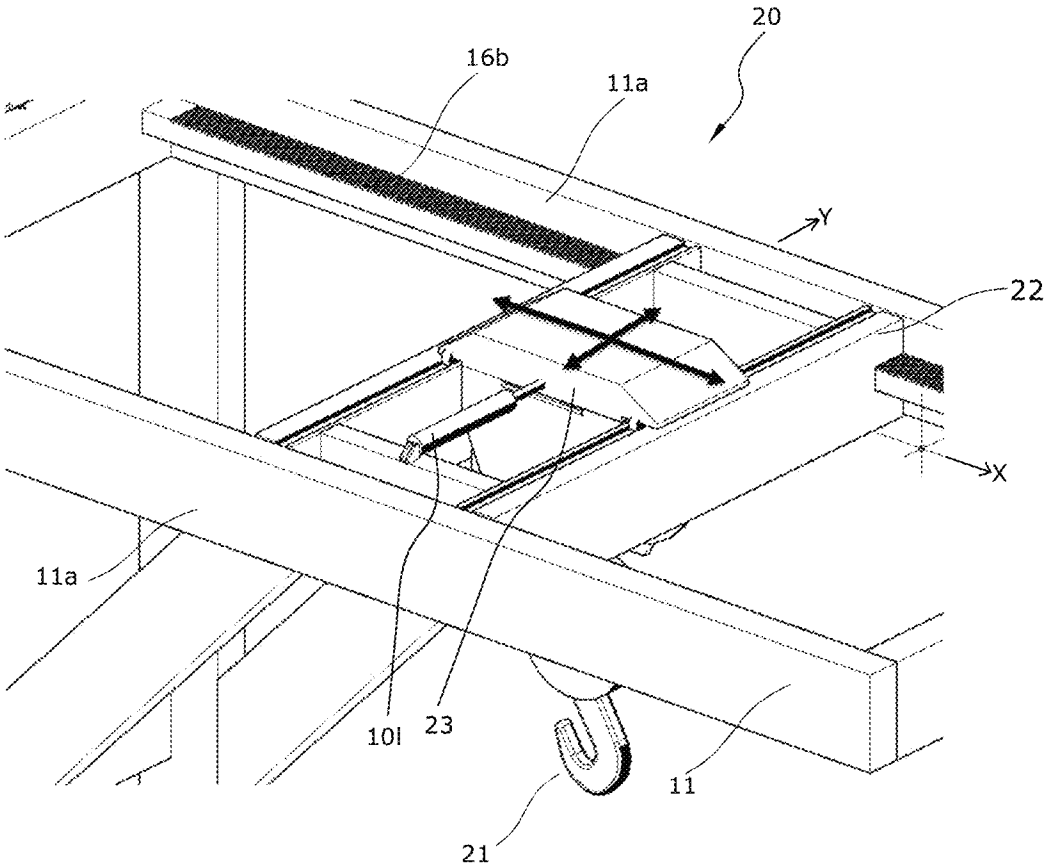
FIG. 7*b* shows a detailed view of the lifting arrangement, perspective viewed.

The deck hoist tractor 2 comprises a positioning apparatus 20. The positioning apparatus 20 is arranged in the top frame structure 11. The apparatus comprising a first travel device 22 slidingly arranged in the top frame structure 11. The first travel device 22 is arranged on opposite longitudinal sides 11*a* of the top frame structure 11 (FIG. 7*b*). The first travel device 22 is adapted to move in the longitudinal direction of the top frame structure 11. This is in FIGS. 7*a* and 7*b* shown as a direction X.

A second travel device 23 is arranged perpendicular to the first travel device 22. The second travel device 23 is slidingly arranged on the first travel device 22 in the traverse direction of the direction of the first travel device 22. This is shown as a direction Y in FIGS. 7*a* and 7*b*. This facilitates a movement in two plane, both in the longitudinal direction and in the transverse direction. This provides an exact positioning of the load 6 to be lowered or lifted on the platform 1.

Both the first and second travel device could preferably both be a rack and pinion 100 and/or hydraulic drive 101 so that the movement of the devices 22, 23 are performed controllable and with high precision. The movement of the devices can be shifted between normal or creep speed modus. This is shown in detail in FIG. 7*b*. In this figure it is shown a rack and pinion 100 where the first travel device 22 is moved along. The second travel device 23 is in this figure moved by a linear motor 23*a*, for instance hydraulic piston.

Figure 5:
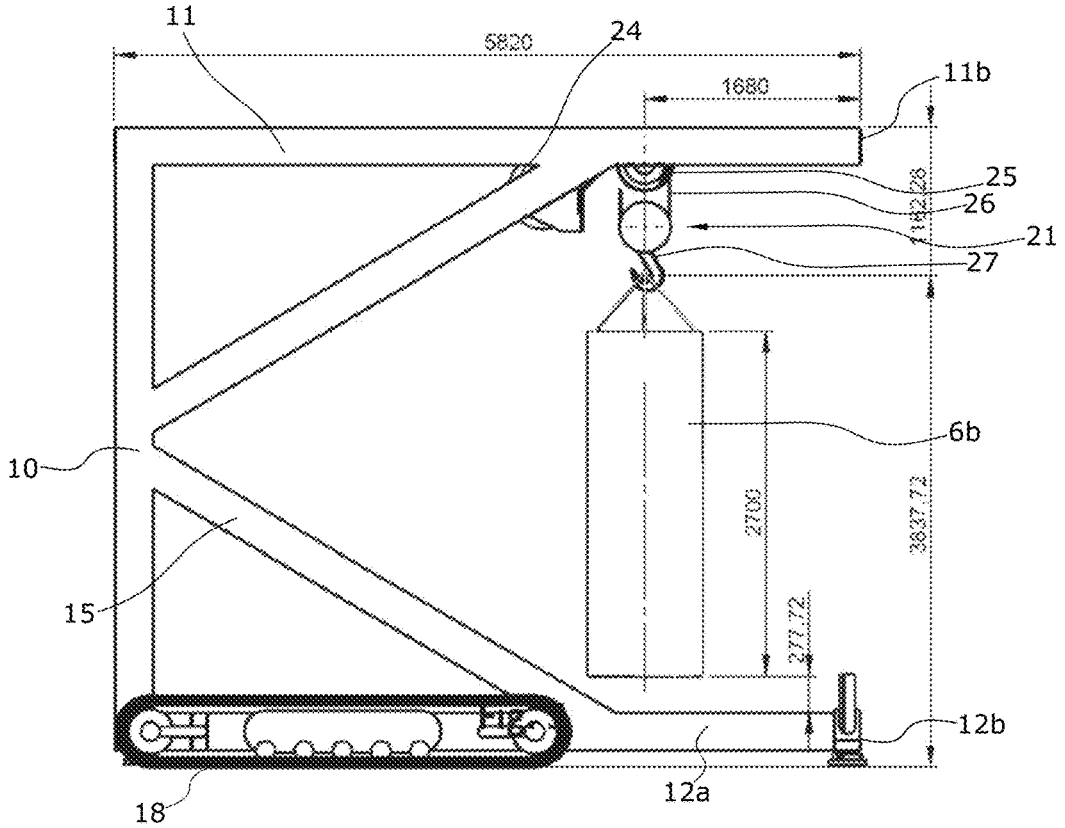
FIG. 5 shows the deck hoist tractor according to the invention viewed from the side.

The deck hoist tractor 2 further comprising a hoisting apparatus 21 suspended from the positioning apparatus 20. The hoisting apparatus 21 could be of different types, for instance a tackle with fall block 25, rope or wire 26 and a hook 27 as shown in FIG. 5. The hoisting apparatus 21 could also be other types such as a single hook suspended in a wire or rope (not shown) or a lifting cap 40 suspended from a wire or rope (FIG. 8-9).

The hoisting apparatus also comprises a winch 24 for hoisting the load 6 up or down in the deck hoist tractor 2.

To provide a safe hoisting operation especially over critical areas with for instance pressurized equipment it is important to have a redundant hoisting apparatus 21 to ensure that the load 6 do not drop if the hoisting apparatus 21 fails.

There could therefore be arranged a double winch system (not shown) with an additional winch (not shown) which is interconnected with the main hoisting system. If the main hoisting apparatus 21 fails, the second winch will take over the hoisting operation.

FIG. 5 shows the deck hoist tractor 2 viewed from the side. In this figure, the hoisting apparatus or winch system 21 is shown in greater detail with the tackle 25, rope or wire 26, hook 27 and the winch 24 to handle the load. The tackle 21 is known per se.

There is also illustrated in this figure that the cantilevered beams 12 and the top frame structure 11 are arranged in parallel planes that are spaced apart in the vertical direction.

It is also illustrated that both the elongated base structure 12 with the cantilevered beams 12*a* and the top frame structure 11 are extending outside of the caterpillar drive 18 at the front end of the deck hoist tractor 2. This makes it easy for the deck hoist tractor 2 to be positioned near a hatchway opening 5*a* or opening in the deck 4*a* and perform the lifting operations through the hatchway opening 5*a* or opening in the deck.

Detail of the caterpillar drive 18 is also shown in FIG. 5 and is also known per se.

Figure 6:
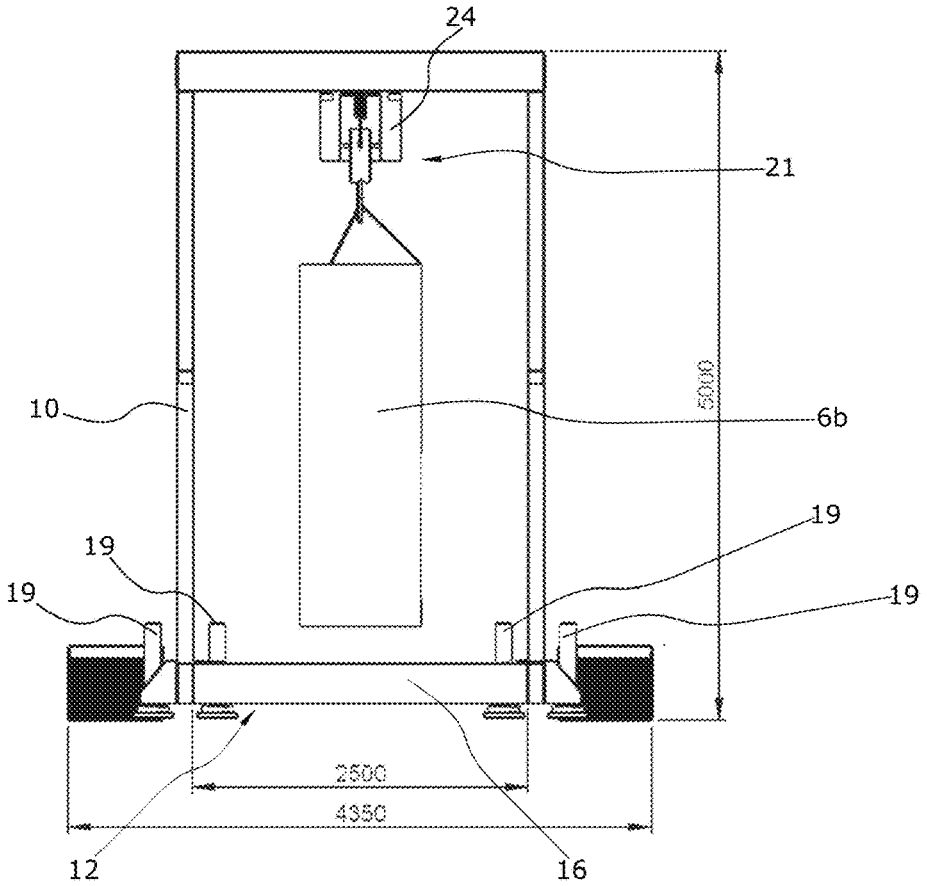
FIG. 6 shows the deck hoist tractor according to the invention, viewed from behind.

FIG. 6 shows the deck hoist tractor viewed in front of the deck hoist deck tractor 2. It is clear from this figure that the load 6 is suspended in a frame like structure 10, 11, 12.

FIG. 7*a* shows the deck hoist tractor 2 viewed from above. This figure illustrating the support structure 19 that is arranged in each of outer corners on the deck hoist tractor 2. The support structure 19 are arranged at each end of each of the cantilevered beams 12.

The FIGS. 7*a* and 7*b* show a detail view of the positioning apparatus 20 with the first travel device 22 which is adapted to move in the longitudinal direction of the deck hoist tractor 2. The second travel device 23 is attached to the first travel device 22 and is adapted to be moved in the transverse direction.

The hoisting apparatus 21 is suspended from the second travel device 23 and allowed to move both by the first travel device 22 along the axis defined as x in the figure and further along the axis y arranged perpendicular to the x-axis.

This results in that the load may be positioned in any coordinates (x, y) within the top frame structure 11.

The deck hoist tractor 2 has several driving mechanism that must be performed dependent on the different operation of the deck hoist tractor 2. In the transportation-operation, the tractor 2 is moved by the caterpillar drives 18. Prior to the hoisting operation, the support structure or structures 19 must be lowered to the ground. During hoisting-operation both the positioning apparatus 20 and the hoisting apparatus 21 must be operated to perform the necessary action.

All of the operation could be driven by a system comprising pressurized air system and hydraulic system. Air is supplied from the utility stations of the platform, like the support operation vessel or jack up rig through an air hose. The air hose (not shown) could be winded up and attached either directly to the deck hoist tractor 2 or the platform 1. The pressurized air from the hose could directly act on a hydraulic power or pump unit which ensures the movement or operation of the different driving mechanism. Another possibility is that the deck hoist tractor 2 may be equipped with an accumulator where pressurized air may be stored and further be used to operate the hydraulic power unit when needed.

The hydraulic power unit or pump is adapted to provide a hydraulic motor with the hydraulic fluid in order to operate the different drive mechanism. The motor could for instance be a linear motor.

The different drive mechanism are adapted to be operated independently of each other, there could thus be arranged separate hydraulic motors to each of the drive mechanism that are to be perform on the deck hoist tractor 2.

The air and hydraulic systems are more safe with respect to risk for explosions then for instance electrical cable. This makes it possible to use the deck hoist tractor 2 without restrictions on the platform also in hazardous areas where there are restriction to what equipment that could be used.

The caterpillar drives 18 could have individually operated brake mechanism attached to the respective caterpillar. This provides that the tractor 2 may be turned by decelerating one of the caterpillar drives 18 of the deck hoist tractor. Separate hydraulic motors operating each of the belt will provide for this operation.

The swinging movement of the tractor 2 could also be performed by other means.

FIGS. 8 and 9 shows the different positioning of the load when the tractor 2 is in the hoisting operation as shown in FIG. 8 and in the transportation operation as shown in FIG. 9.

In FIG. 8 the deck hoist tractor 2 will use the frame structure 10, 11, 12 and the support structure 19 to constitute a foundation that is able to lift the load 6 outside of the center of gravity of the deck hoist tractor 2. The positioning and lifting apparatus 20, 21 are in this operation moved to the outer free end of the top frame structure 11.

In FIG. 9 the positioning of the positioning and hoisting apparatus retracted to the other longitudinal end of the top frame structure 11. In this position the center of gravity of the load and the center of gravity of the deck hoist tractor are substantially the same. This makes it easier and more safe to transport the load 6 by the deck hoist tractor 2. In the FIGS. 8 and 9 the load is a conductor cutting 6*a* and a lifting cap 40 is attaching the conductor cutting 6*a* to the tractor 2. The figure also defines the maximum possible length of the conductor cuttings 6 to be transported.

The deck hoist tractor 2 is designed for safe operations, and special considerations have being made for operation close to hatch openings 5*a* resulting in a design with retractable telescopic supports/foots 19 in front.

The deck hoist tractor 2 will be well suited for high accuracy installation lift as it will be able to move and correct position in both axes horizontally combined with very controllable hoisting, all in creep mode speed.

The total weight of the deck hoist tractor is typically 7.5 t, but other weights are possible.

The lifting capacity of the deck hoist tractor could typically be to SWL 10 t

The deck hoist tractor 2 will be able to cover all lifting, installation and transportation needs for materials in general and for parallel well completion, for instance x-tree 6*a*, unihead etc. In the figures it will be able to lift and transport conductor cut-offs 6*b* of lengths up to 3.35 meters if using a lifting cap and typical cargo unis of sizes as seen in FIG. 16*a*-16*b*. Other designs of the deck hoist tractor 2 could give other capacities for the tractor.

Use of the deck hoist tractor 2 for installation/completion after drilling will make it possible for the drilling rig to skid to new location and start drilling on next well without interruption. A typical transport and lifting sequence of an x-mas tree 6*a* is shown in the FIGS. 10-15. The load could however be other loads 6.

Figure 10:
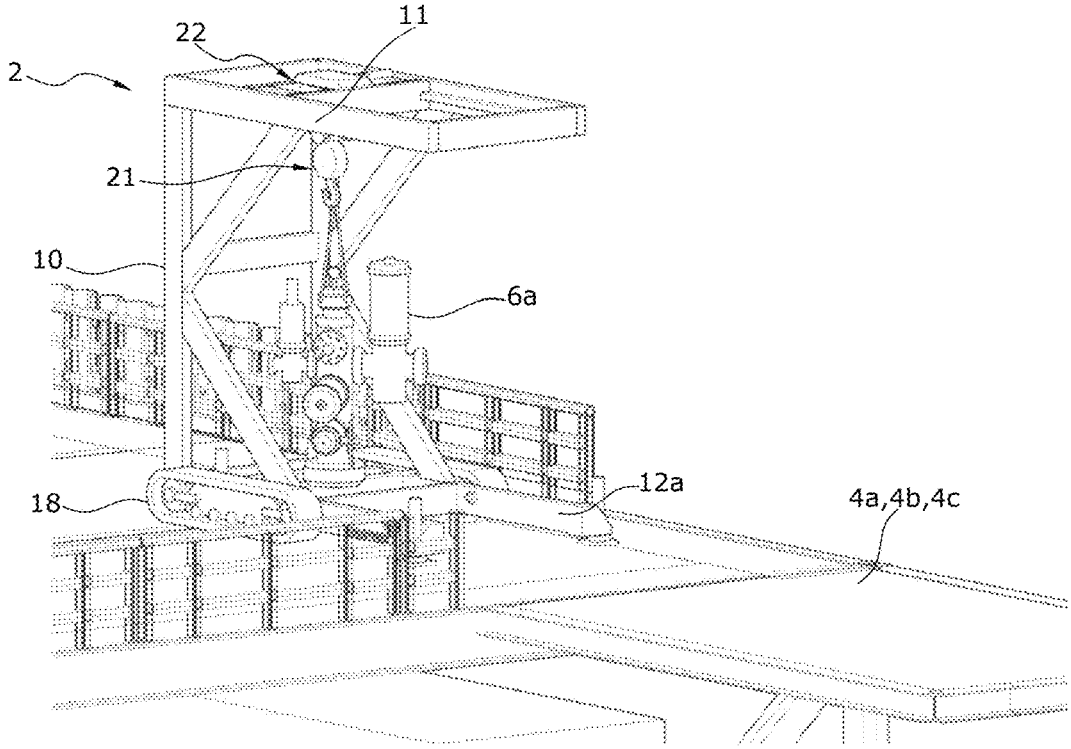
FIG. 10-15 shows the sequence for moving a load from one location to another location by use of the deck tractor.

FIG. 10 shows the transportation of the xmas tree 6*a* by the deck hoist tractor 2 to the hatchway opening 5*a* where the x-mas tree 6*a* is to be lowered. The x-mas tree 6*a* is suspended from the hoisting apparatus 21 that is positioned above the caterpillar drives 18. The load 6 is in the retracted position (also shown in FIG. 9) suitable for being transported by the deck hoist tractor 2.

Figure 11:
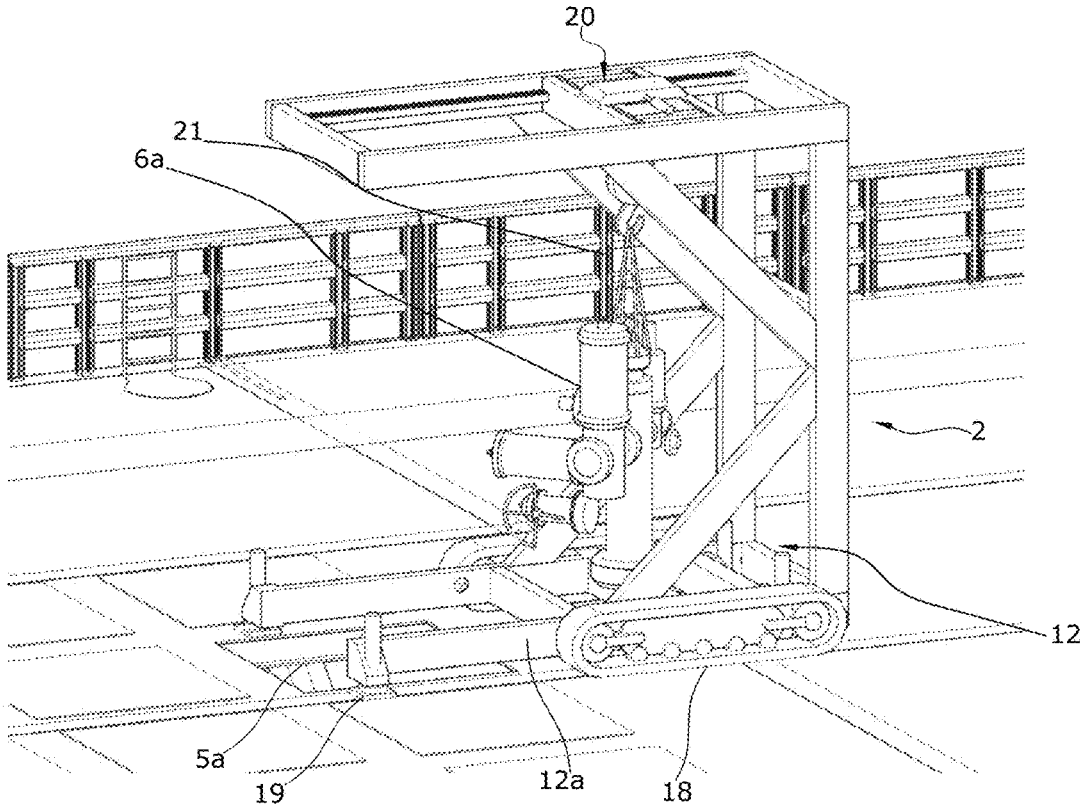

FIG. 11 shows the positioning of the deck hoist tractor 2 prior to the hoisting operation. The tractor 2 is arranged so that the respective cantilevered beams 12*a* are position on opposite sides of the hatchway opening 5*a*. The support structures 19 are then lowered telescopically towards the platform deck 1 and fastened in this extended position.

The deck hoist tractor 2 constitutes now a foundation or a stable frame on the platform deck 1 supported on all four corners of the elongate base frame structure 12 of the tractor.

Figure 12:
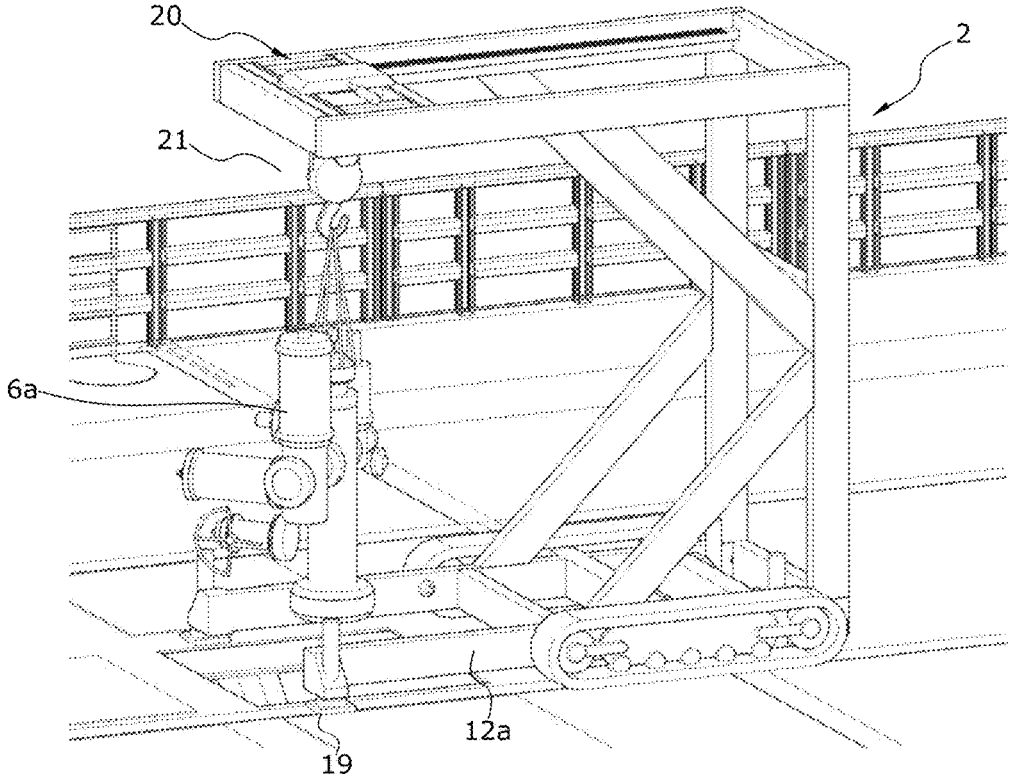

In FIG. 12 the X-mas tree is moved towards the hatch opening 5*a* by moving the first travel device 22 in the longitudinal direction towards the hatch opening 5*a*.

Figure 13:
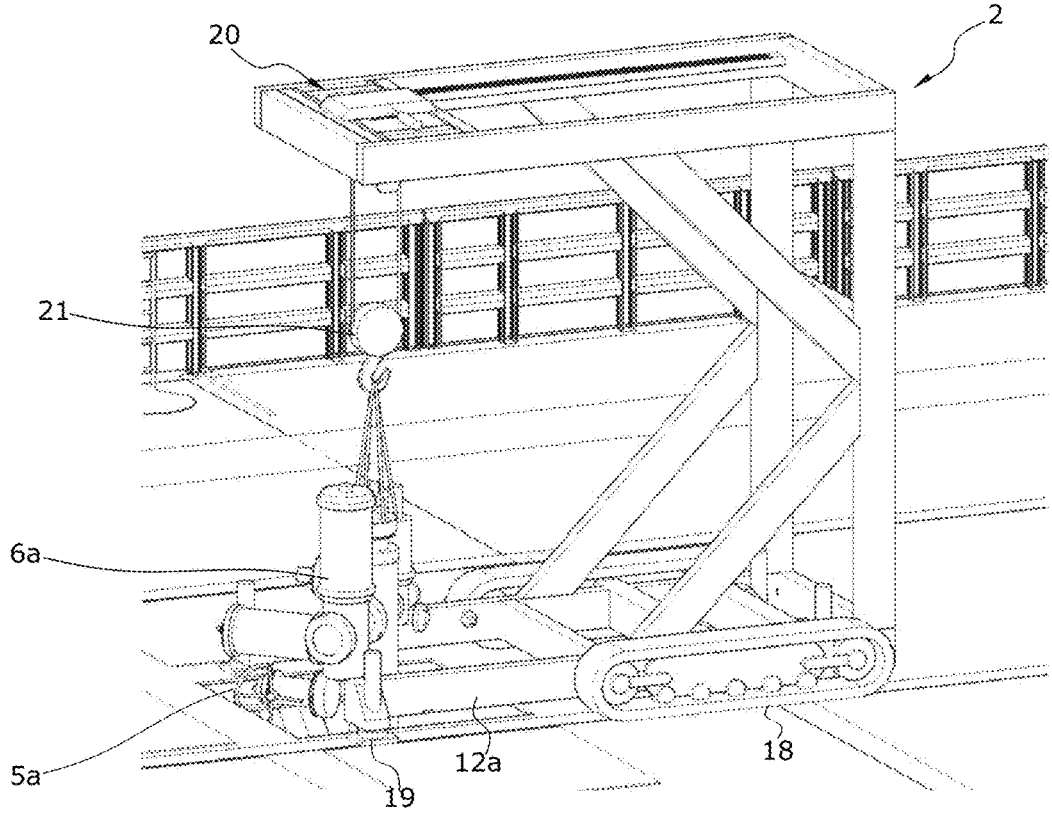
Figure 14:
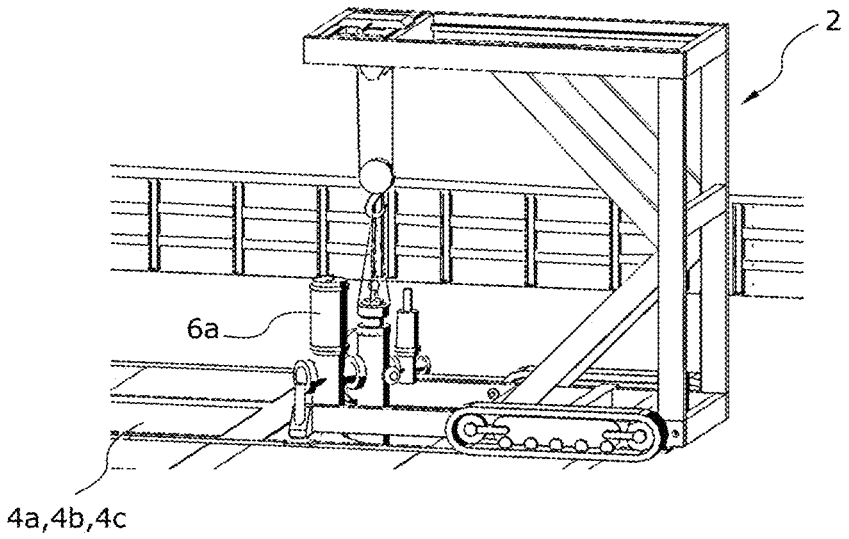
Figure 15:
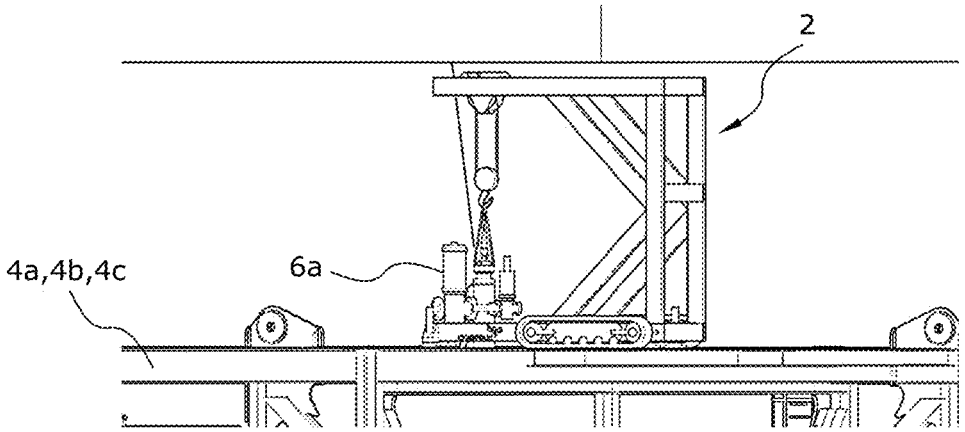

FIG. 13-15 shows the lowering of the x-mas tree 6*a* through the hatch opening 5*a* towards the well head (not shown). The x-mas tree 6*a* must be lowered to the exact position when it is to be attached to the well head 6*a*. It could therefore be necessary to adjust the position by the second travel device 23 and possible further by the first travel device 22 before the exact position is obtained.

Figure 16:
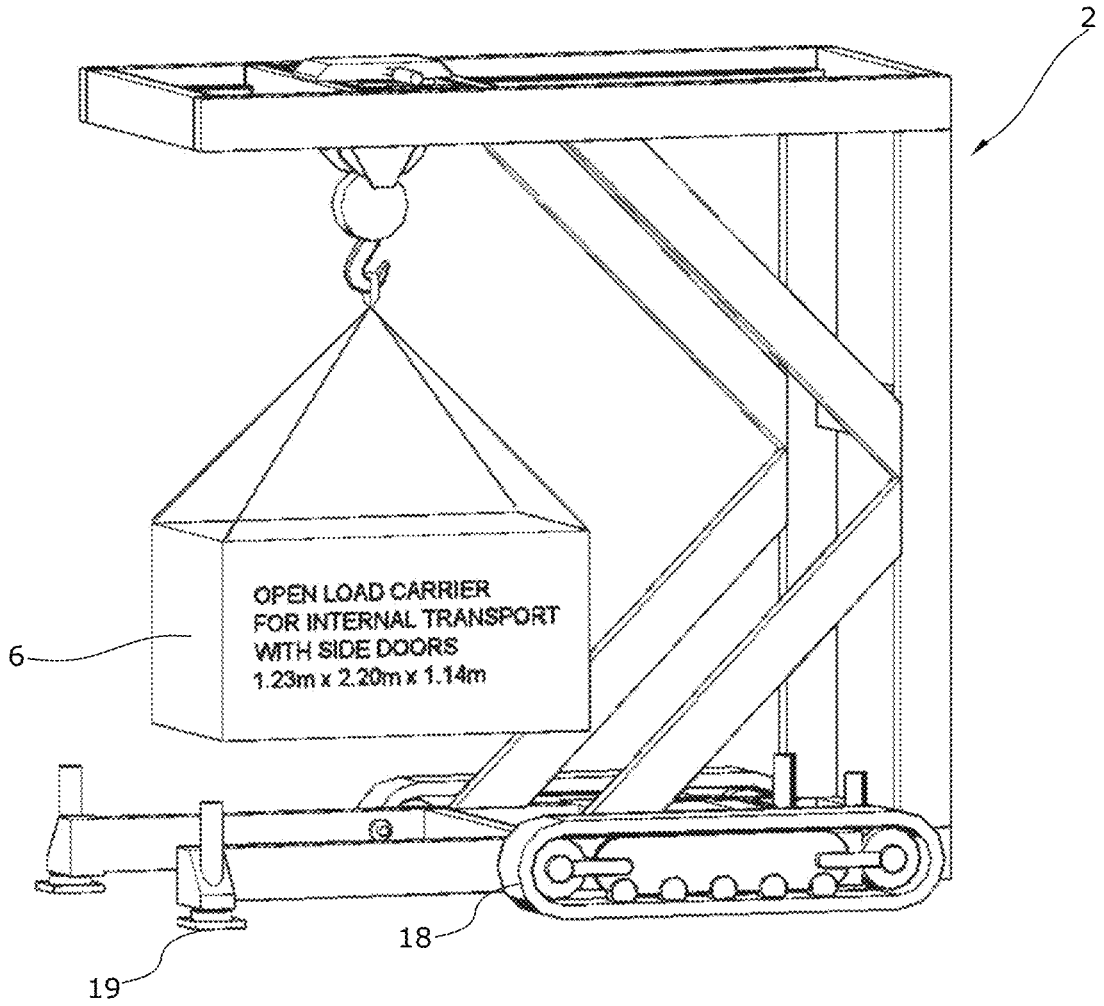
FIG. 16 shows an example of loads that could be handled by the tractor

FIG. 16 shows another other example of suitable load the deck hoist tractor 2 can handle, such as dry goods and open load car.

An escape cute 54 according to the invention shall only be installed during all visits on the unmanned wellhead platform 1 by the service operation vessel 3. The escape chute could therefore be temporarily installed by the service operation vessel 3 or the main crane 51 of the platform 1. A perspective view of the installation of the escape chute 54 by the support operation vessel is shown in FIG. 1.

Figure 17A:
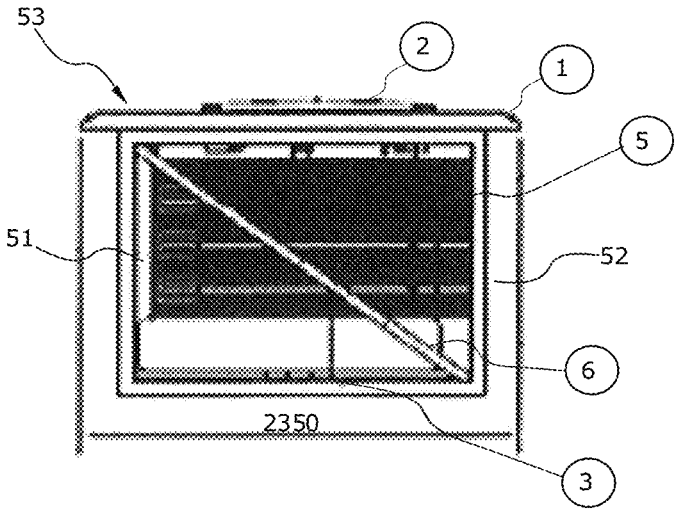
FIG.17a (prior art)
FIG. 17*a*-17*b* shows a traditional escape chute viewed in retracted and extended position.
Figure 17B:
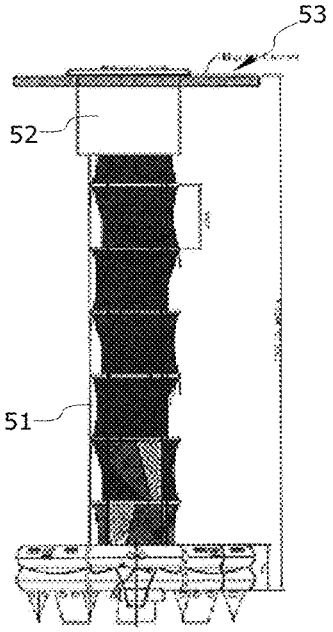
FIG.17b (prior art)

The principle of a traditional escape chute 53 is that it is a special kind of emergency exit, used where conventional fire escape stairways are impractical. The chute 53 is normally a fabric tube that is installed near a special exit of a tall structure. During use the chute 53 is deployed. The persons to be rescued may then enter the tube and slide down to a lower level. A typical escape chute 53 is shown in FIGS. 17*a* and 17*b*. FIG. 17*a* shows the traditional escape chute 53 with a tube 51 arranged in a retracted position within a chute box 52.

FIG. 17*b* shows the deployed escape chute 53 with the tube 51 suspended from the chute box 52.

Figure 18:
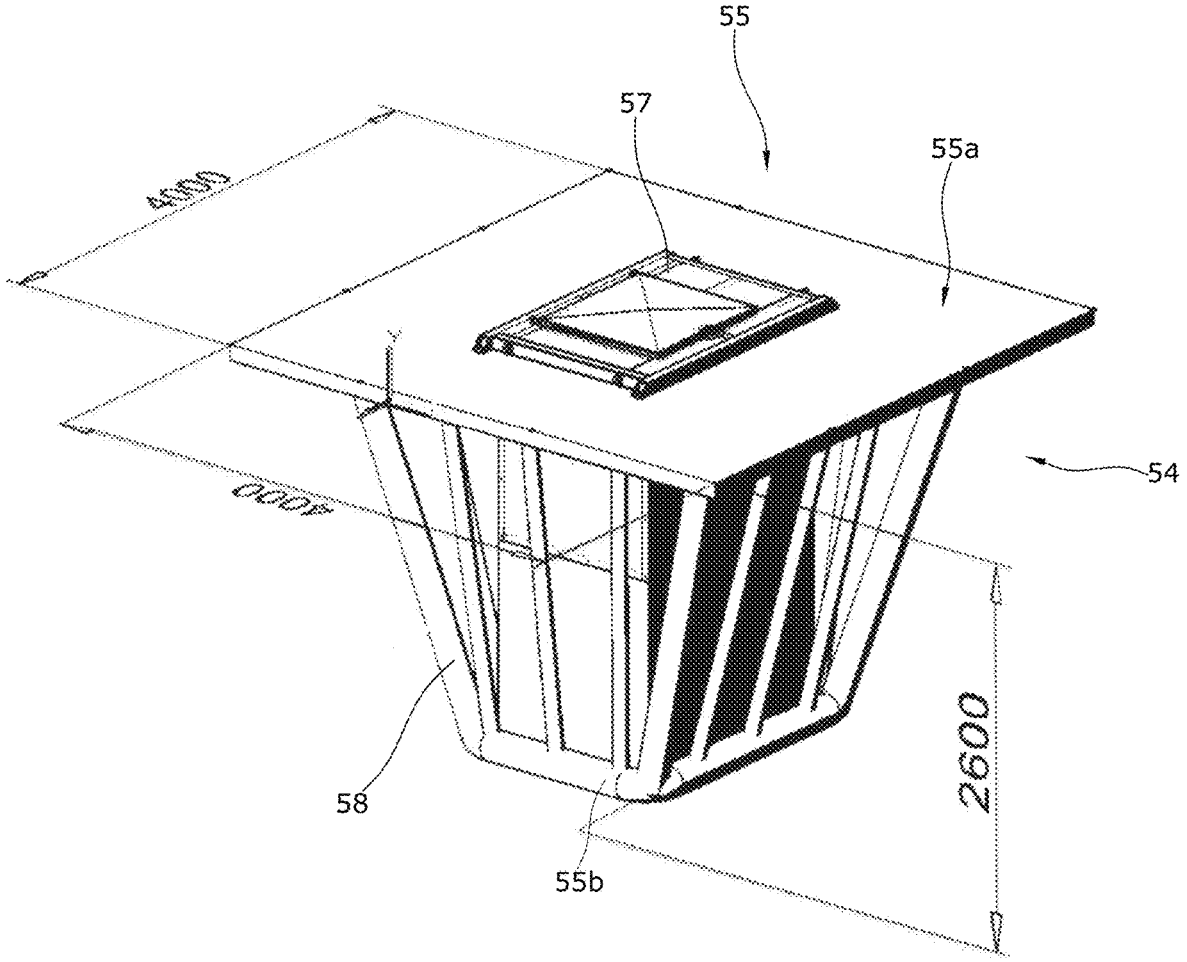
FIG. 18 shows a detailed view of an escape chute according to the invention without handrails.

An escape chute 54 according to the invention comprises a main part 57 similar to the escape chute 53, shown in FIGS. 17*a* and 17*b*. The main part 57 is arranged within a frame structure 54. This is shown in FIG. 18.

The frame structure 55 comprises a supporting part 55*a* and a protecting part 55*b*.

The supporting part 55*a* is designed as a deck or sheet 55*a* with an opening in the middle where the main part 57 is mounted. The main part 57 is extending from the sheet 55*a* towards a distal end.

The protecting part 55*b* is in the figure shown as a number of pipes 58 that are evenly distributed around the main part 57 between the distal end of the main part 57 and the supporting part 55*a*.

The pipes 58 are attached a distance from the border of the supporting part 55. The border of the supporting part 55*a* has a planar surface. The protecting part 55*b* could have other designs as long as it is covering the main part 57 extending from the supporting part 55*a*.

Figure 19:
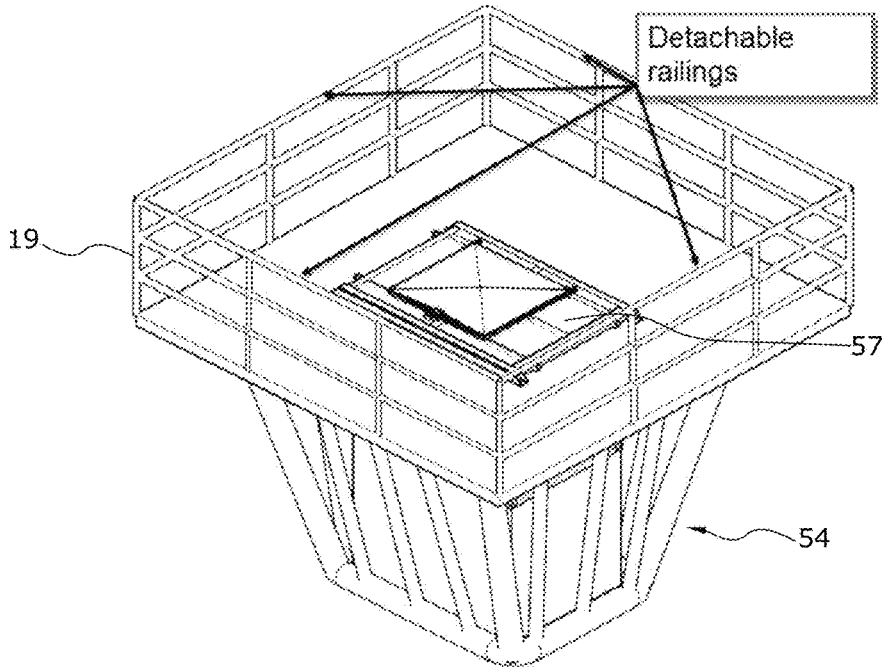
FIG. 19 shows a detailed view of an escape chute according to the invention with hand rails mounted on the frame.

FIG. 19 shows the escape chute 54 according to the invention with hand rail or rails 59. The hand rail or rails 59 are detachable.

Figure 20:
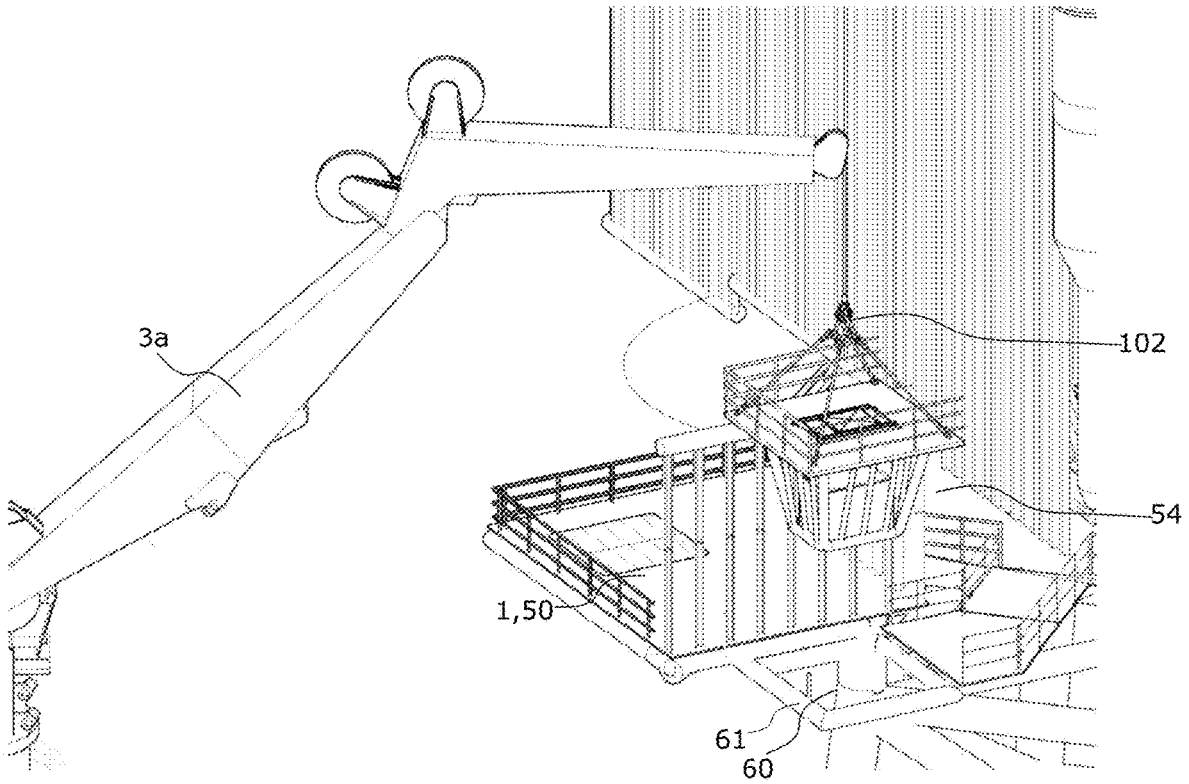
FIG. 20-22 shows the installation sequence of the escape chute according to the invention on the platform.
Figure 21:
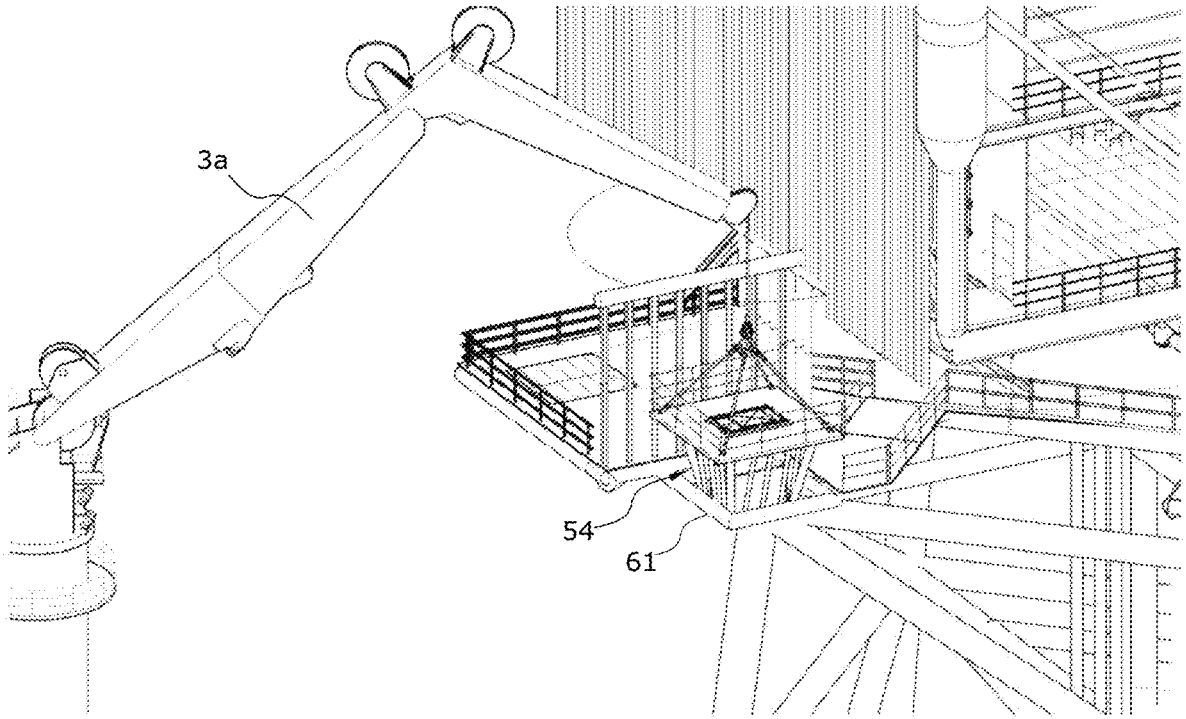
Figure 22:
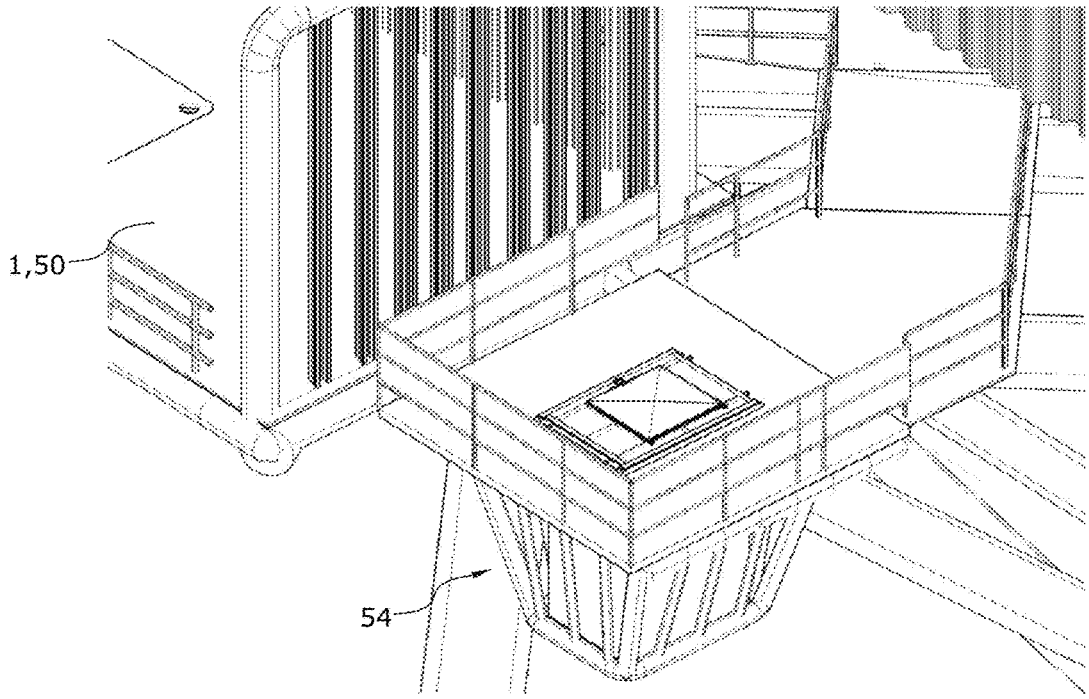

The installation of the escape chute 54 is shown in FIG. 20-22.

The escape chute 54 could be installed in an opening 60 in a landing platform 50 or directly in an opening in the platform deck 1.

The landing platform 50 is an extended platform part that is situated at the lower deck of the platform to ease the handling of loads to and from the platform 1. The landing platform 50 is further described in PCT/NO2016050015 by the same applicant o which reference is made.

In the FIG. 20 there is shown an opening 60 with only a simple guiding or resting frame 61 along two sides surrounding the opening 60. The chute unit 54 is designed to be installed directly by the support operation vessel crane 3*a* or the platform crane 51 as shown in FIG. 20-21. The chute unit 54 is designed to be installed by a self-release hook 102 that allows the chute 54 to be installed before people is entering the unmanned wellhead platform 1.

FIG. 22 shows the chute unit 54 installed on the platform 1. After installed on the platform 1 the hand railing or railings 59 towards the unmanned wellhead platform 1 is removed.

By installing the hand railings 59 on the escape chute 54 the opening with the guiding or resting frame 61 on the platform 1 could be a simple frame 61 without railings 59.

The chute unit 54 is uni-directional and designed to give spacious tolerances and guiding for installation lifts.

The weight of the unit 54 could be typically, but not limited to 2.8 t in total. The frame structure could for instance be made of aluminium.

Figure 23:
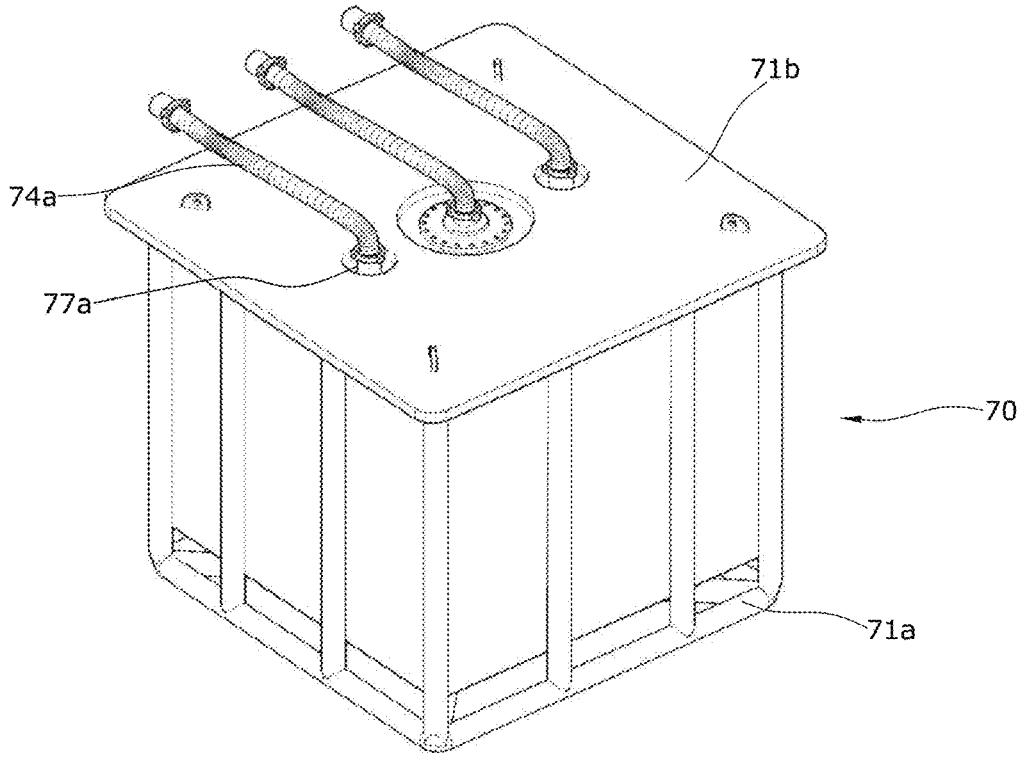
FIG. 23 shows a tote tank for installation on an unmanned platform.

FIG. 23 shows a tote tank 70 adapted to be temporarily installed on the unmanned platform 1. The tote tank 70 has a frame structure 71*a*, 71*b* enclosing the main part of the tank. This frame provides support to the lifting of the tank 70 and protect the tank 70 both in the installation process and during operation on the platform 1. The FIG. 23 shows a girder structure 71*a* and a top cover 71*b* surrounding the main part of the tank other designs of the frame is however possible.

The tank 70 also comprises connections 77*a*, 77*b*, 77*c* that are adapted to be connected to flexible hoses 74*a*, 74*b*, 74*c* when installed on the platform 1 or landing platform 50. The flexible hoses 74*a*, 74*b*, 74*c* creates connection between the tote tank 70 and the tank or equipment to be drained on the platform 1.

There are shown three flexible hoses 74*a*, 74*b*, 74*c* connected to three connections 77*a*, 77*b*, 77*c* at the tank but this number of connections and flexible hoses may wary according to the specific purpose of the tank 70.

The flexible hoses 74*a*, 74*b*, 74*c* could also have a part that is rigid and not flexible.

The installation process of the tote tank is further described in relation to the FIG. 24-33.

Figure 24:
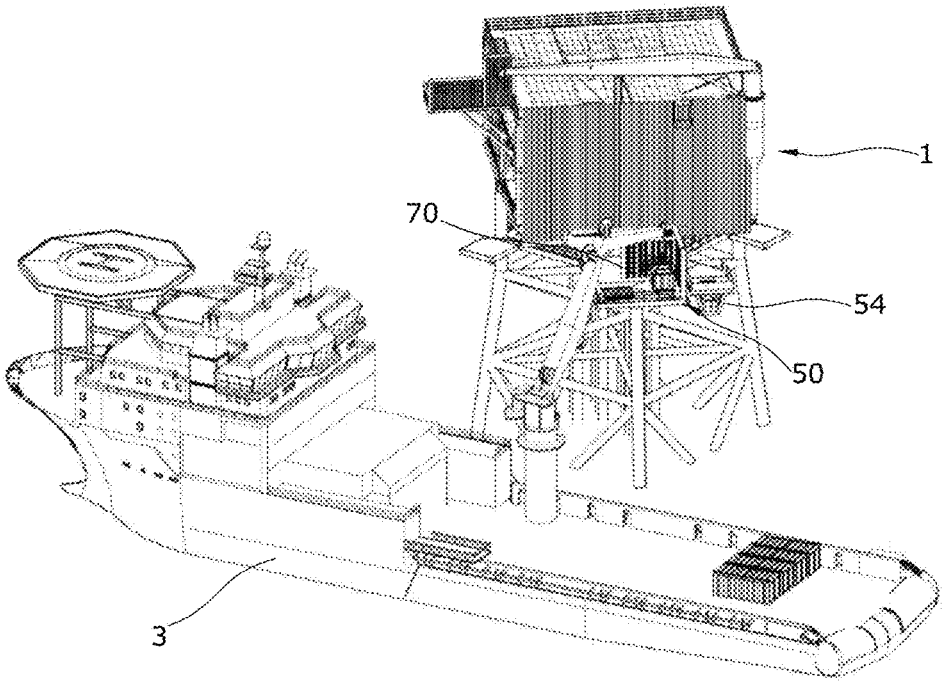
FIG. 24 shows an overview of the unmanned platform and the service operation vessel.
Figure 25:
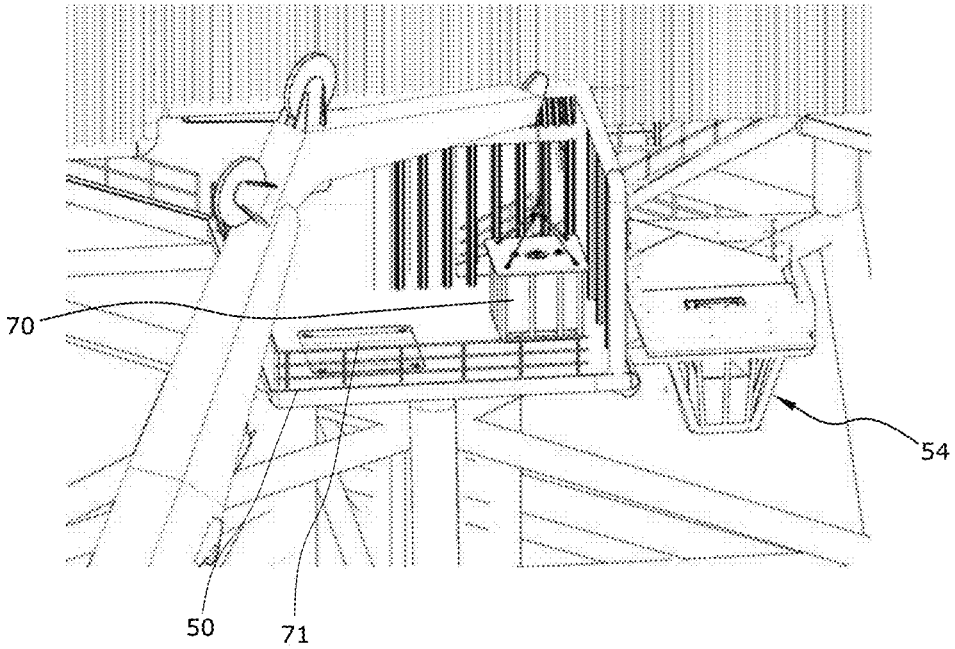
FIG. 25-33 shows the installation process for installing the tote tank on the platform.
Figure 26:
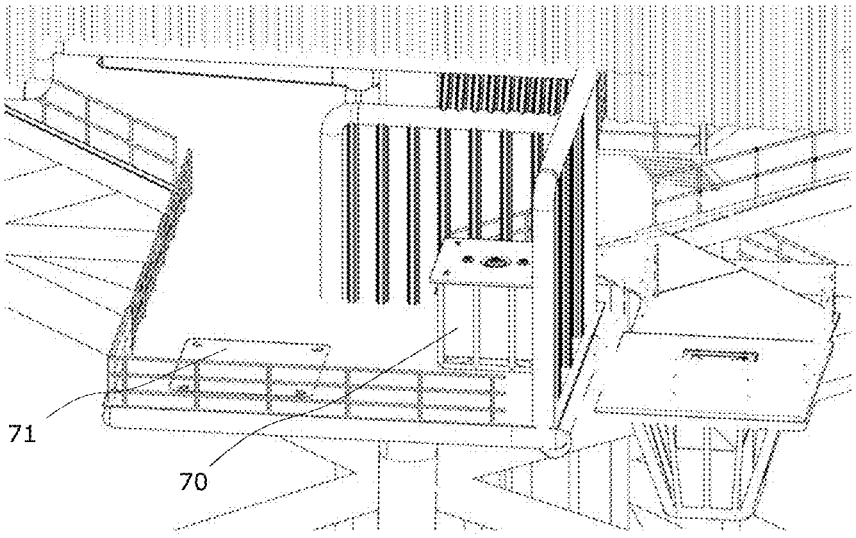
Figure 27:
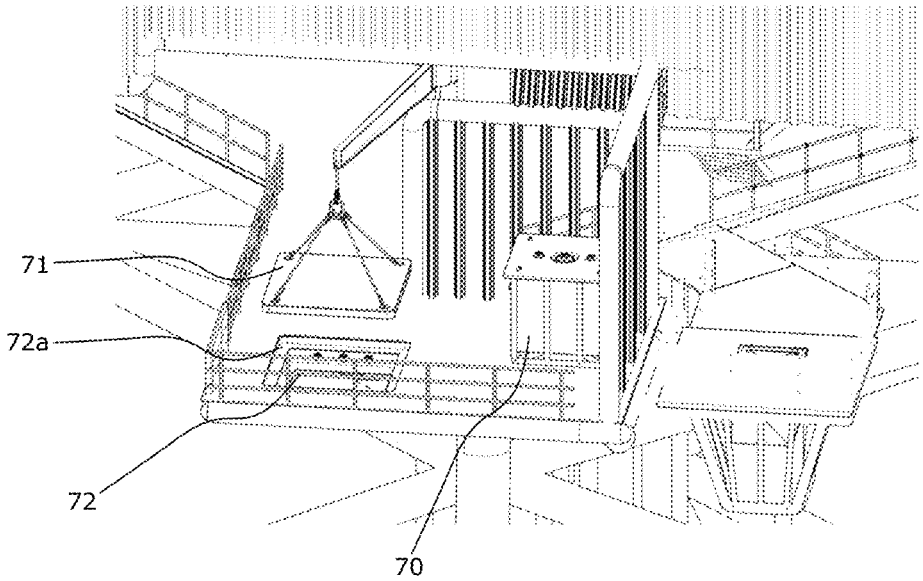
Figure 28:
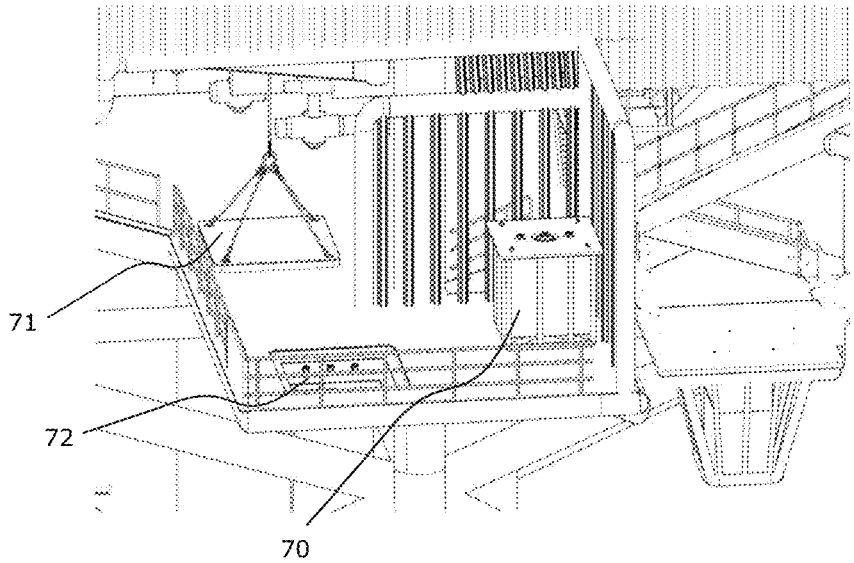

The FIGS. 24 and 25 shows the movement of the tank 70 from the service operation vessel 3 to the landing platform 50 or another suitable location on the platform 1. The landing position must be easy to access by the crane, which handle the movement of the tank 70 to the platform. This can be performed by the crane 3*a* on the service operation vessel 3 or a main crane 51 (FIG. 1) on the platform 1. The tote tank could have hooks 79 (FIG. 34) integrated in the top cover of the tote tank 70 to facilitate the lifting of the tank 70.

As shown in FIG. 25, the tote tank 70 is temporarily stored on deck of the platform 1 before installed in a recess 72. The recess forms an opening in the platform deck 1 or landing platform 50 where the tote tank is to be installed.

FIG. 26-31 shows the installation process of the tote tank 70 to install the tote tank in the recess 72 of the platform. There is arranged a hatch cover 71, which covers the recess 72. The hatch cover 71 rest on a first depressed edge 72*a* (FIG. 28-29) surrounding the recess 72. These provides support for the hatch cover 71 and makes sure that the cover 71 maintains its position. The deck and hatch cover 71 are in flush to provide a plane surface when installed in the recess 72.

Figure 29:
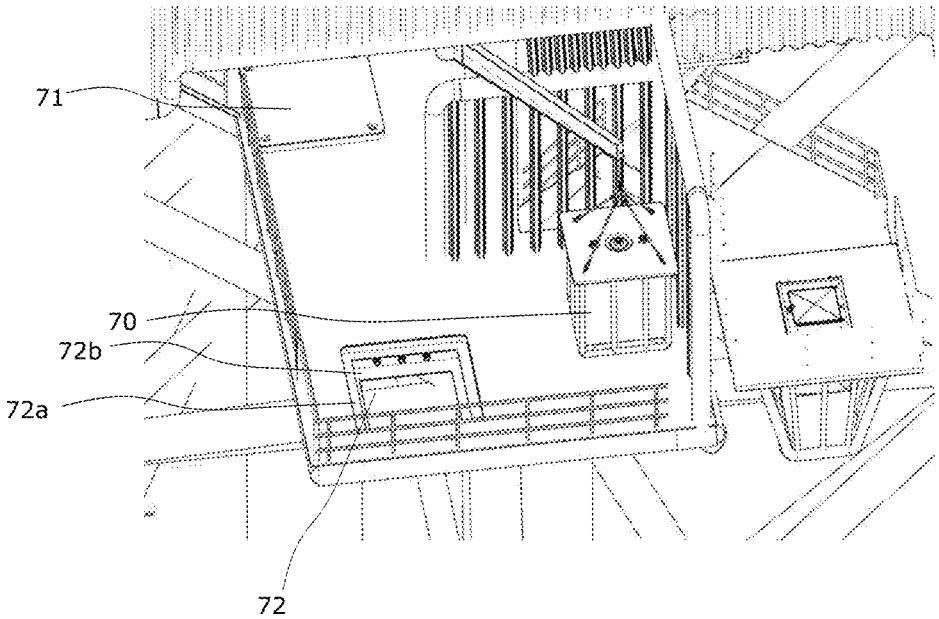
Figure 30:
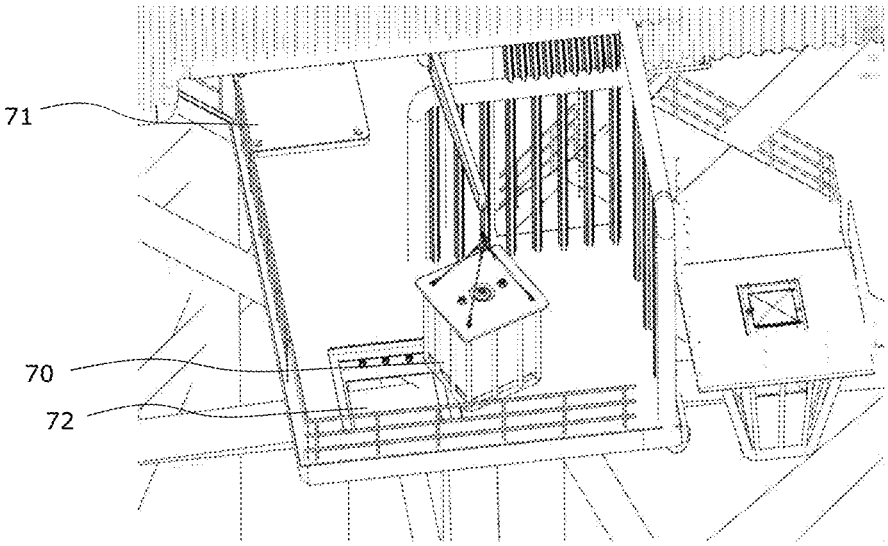
Figure 31:
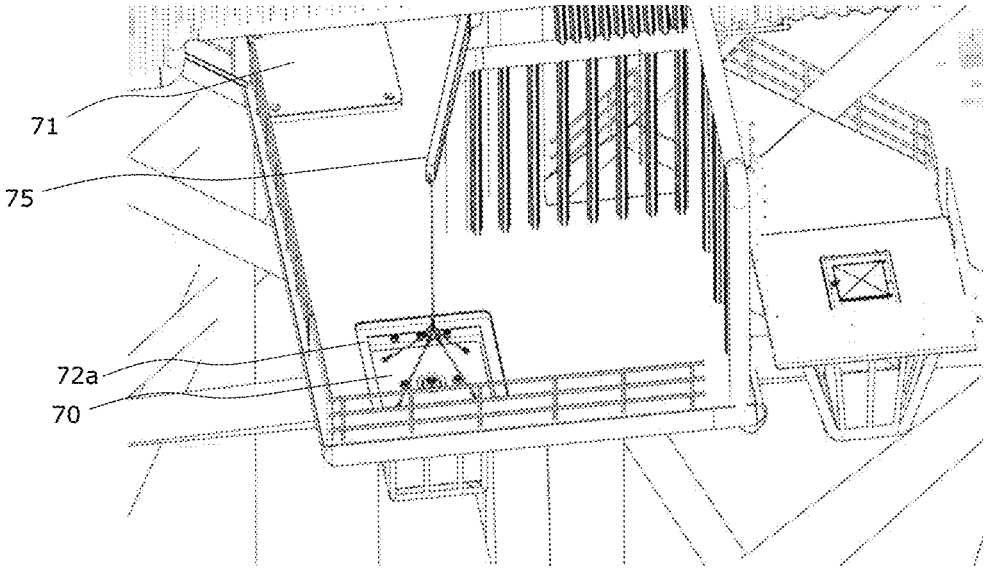

The tote tank is moved into the recess 72 and lowered onto a second depressed edge 72*b* surrounding the recess 72 at a lower level that the first depressed edge 72*a*. The top cover of the tote tank is adapted to rest on the second edge 72*b* (FIG. 29). The main part of the tote tank 70 is then arranged below the deck of the platform.

Figure 34:
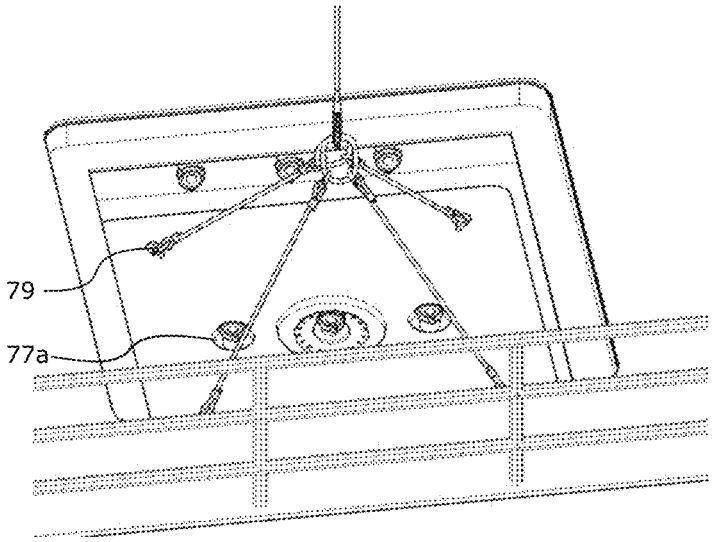
FIG. 34-37 shows the tote tank installed in the platform and the connecting tubes arranged between the tote tank and the devices which are to be drained etc.
Figure 35:
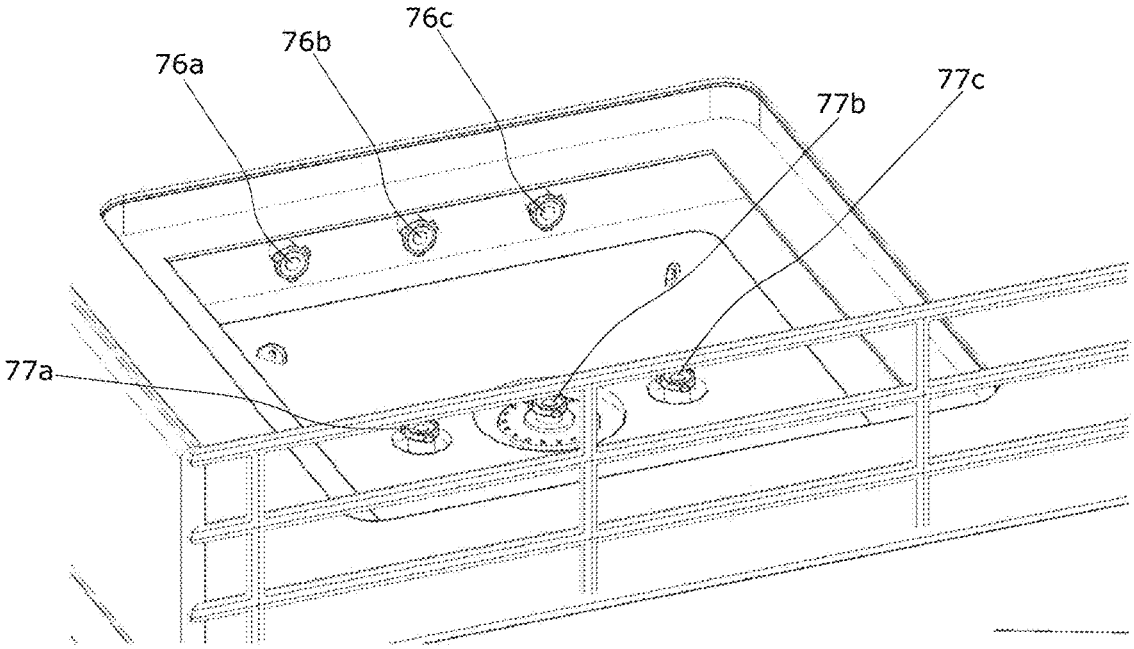
Figure 36:
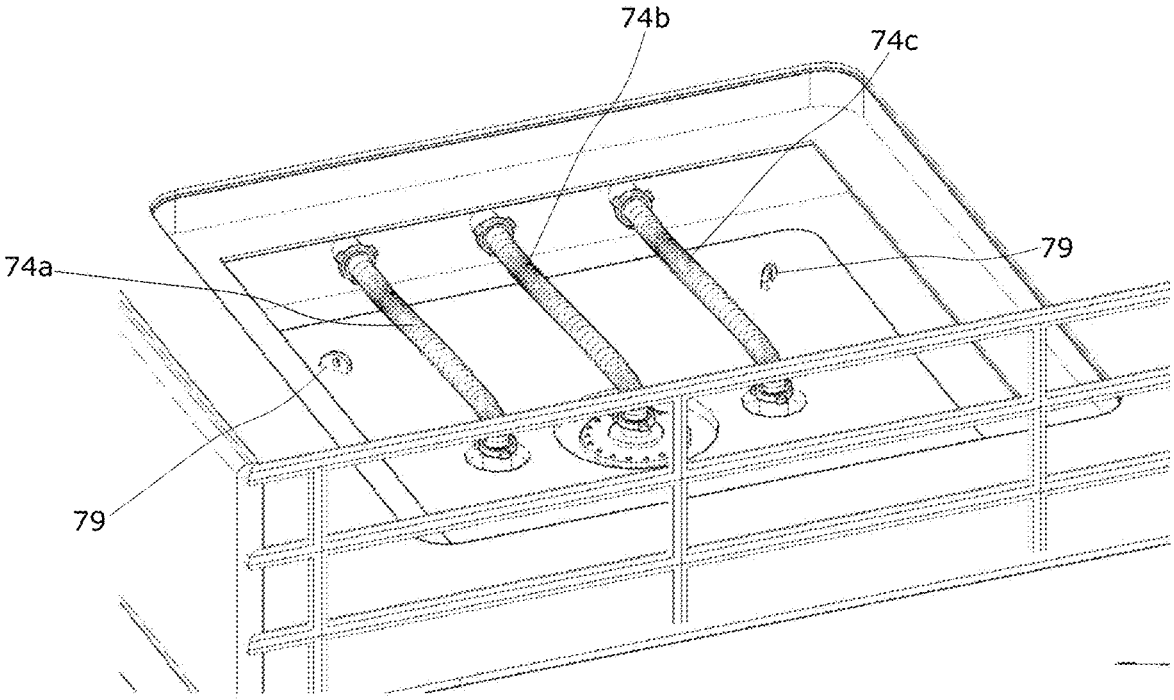
Figure 37:
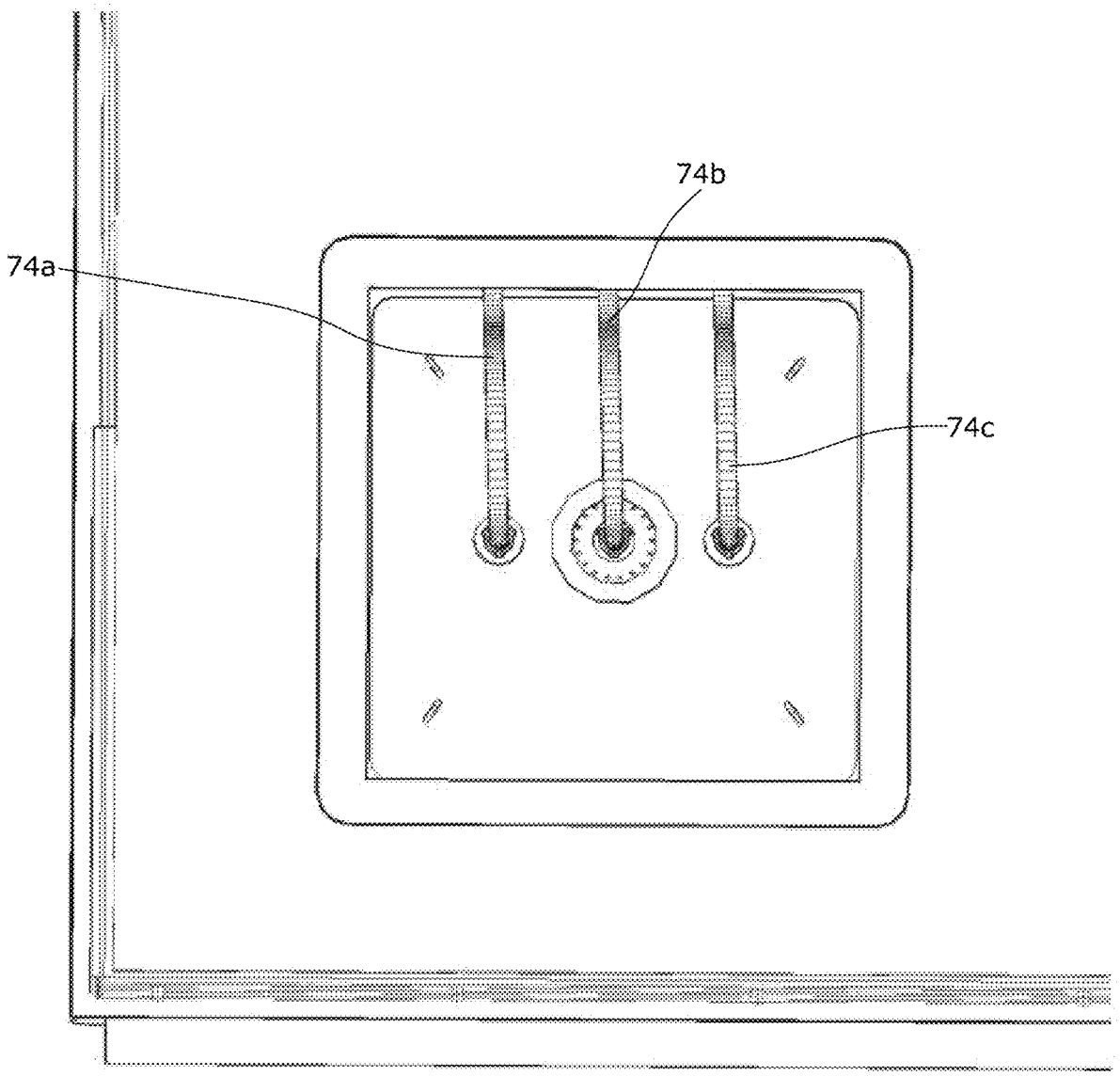

There are also arranged connection in the recess 72 as shown in FIG. 34-36. These are adapted to be connected to the flexible hose 74*a*, 74*b*, 74*c* and fluidly connecting the tote tank 70 with the installation to be drain on the platform.

The purpose of the toe tank 70 on the platform is mostly to remove spill water that could not be flushed to the sea. There tote tank 70 could however be used for draining of other fluids that should be removed from the platform.

Figure 32:
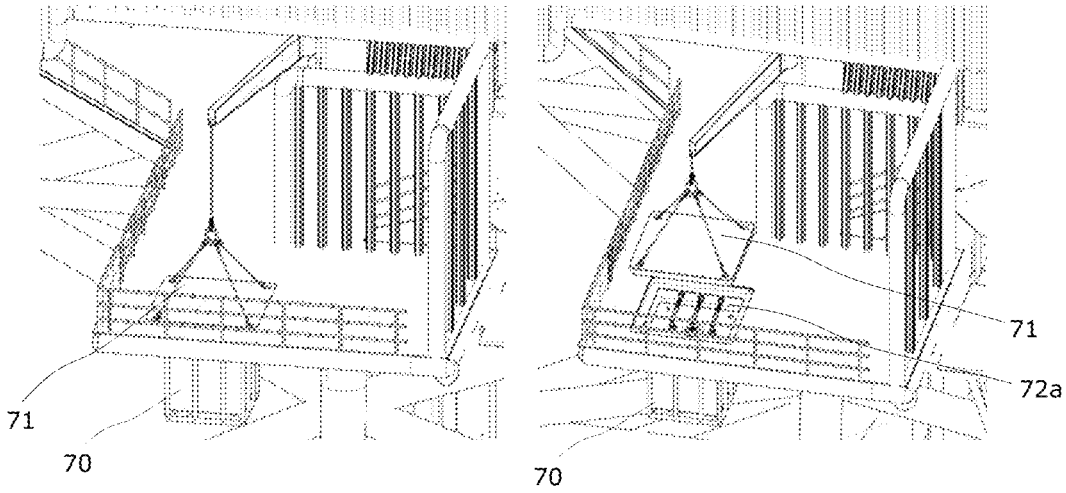
Figure 33:
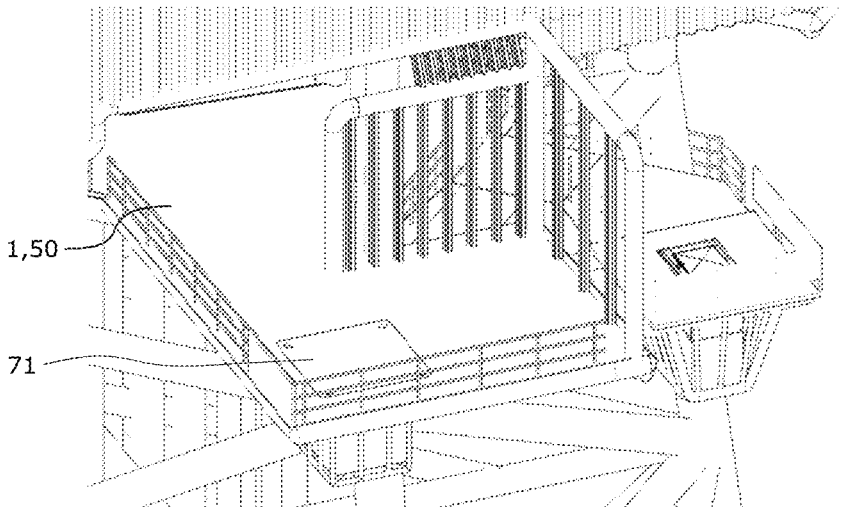

After installation of the tote tank 70 and the connection with the flexible hoses 74*a*, 74*b*, 74*c*, the hatch cover 71 is moved back to the recess 72 and arranged on the first depressed edge 72*a* to cover the tote tank 70 and increase the deck space on the platform 1 or landing platform 50 as shown in FIG. 32-33.

The tank 70 could be connected to the open drain system, pump line and vent by the flexible hose connections 77*a*, 77*b*, 77*c* to connection 74*a*, 74*b*, 74*c* in arranged in the recess 72 through hose connections when installed on the platform 1. An integrated pump (not shown) will drain the tank to the support operation vessel by established hard pipe connections to both walkway to work platforms and main cargo landing. The proposed location, functionally and installation method of the tank 70 will put requirement to the tank layout.

The present invention has been described with reference to a preferred embodiment and some drawings for the sake of understanding only and it should be clear to persons skilled in the art that the present invention includes all legitimate modifications with the ambit of what has been described hereinbefore and claimed in the appended claims.

The invention claimed is:

1. A deck hoist tractor for an unmanned platform, the deck hoist tractor comprising an elongated base frame structure carrying respective caterpillar drives on each side enabling the tractor to move forward and rearward, a tower frame structure extending in substantially vertical direction from one end section of the base frame structure, which tower frame structure is carrying a cantilevered top frame structure carrying a lifting apparatus, the caterpillar drives are located at the same end section as the top frame structure, that the base frame structure is extended by respective cantilevered beams spaced apart with an opening between them, each cantilevered beam having an adjustable support structure adjacent to their distal end from the caterpillar drive, the cantilevered top frame structure is extended to vertically correspond with the respective cantilevered beams, and the lifting apparatus is arranged to be shifted both forward and rearward, in addition to laterally in the top frame structure in order to position a load supported in the lifting apparatus.

2. The deck hoist tractor according to claim 1, comprising a non-ignitable propulsion system configured to operate the motion of the deck hoist tractor and/or the lifting apparatus.

3. The deck hoist tractor according to claim 2, wherein the non-ignitable propulsion system is configured to operate the motion of the at least one support structure.

4. The deck hoist tractor according to claim 1, comprising a non-ignitable propulsion system, the non-ignitable propulsion system comprising a pressurized air system powering a hydraulic system.

5. The deck hoist tractor according to claim 1, wherein the lifting apparatus comprises a positioning apparatus for moving the load in the plane parallel with the top frame structure and a hoisting apparatus for moving the load in a plane perpendicular to the top frame tower structure of the tractor.

6. The deck hoist tractor according claim 5, wherein the hoisting apparatus comprises a first winch system and a redundant second winch system for operation if the first winch system fails.

7. The deck hoist tractor according to claim 1, comprising four support structures arranged respectively at each distal end of the cantilevered beams and at the opposite end section of the base frame, the support structures are adapted to secure the tractor when the tractor is performing a lifting operation in order to prevent the tractor from tipping.

8. The deck hoist tractor according to claim 1, wherein a space between the cantilevered beams corresponds to the opening of a hatchway in the platform so that the respective cantilevered beams are adapted to be positioned at opposite sides of the hatchway.

* * * * *